US005870983A

United States Patent [19]

Sato et al.

[11] Patent Number: 5,870,983

[45] Date of Patent: Feb. 16, 1999

[54] VALVE TIMING REGULATION APPARATUS FOR ENGINE

[75] Inventors: Osamu Sato, Kariya; Akira Hori, Handa; Shuji Mizutani, Kariya, all of Japan

[73] Assignee: Denso Corporation, Kariya, Japan

[21] Appl. No.: 878,001

[22] Filed: Jun. 18, 1997

[30] Foreign Application Priority Data

Jun. 21, 1996 [JP] Japan ..... 8-162037
Jul. 3, 1996 [JP] Japan ..... 8-173921

[51] Int. Cl.[6] ..... F01L 1/344

[52] U.S. Cl. ..... 123/90.17; 123/90.31

[58] Field of Search ..... 123/90.15, 90.17, 123/90.31; 464/1, 2, 160, 161; 74/567, 568 R

[56] References Cited

U.S. PATENT DOCUMENTS

| | | | |
|---|---|---|---|
| 4,858,572 | 8/1989 | Shirai et al. | 123/90.15 |
| 5,012,774 | 5/1991 | Strauber et al. | 123/90.17 |
| 5,078,647 | 1/1992 | Hampton | 123/90.17 |
| 5,184,581 | 2/1993 | Aoyama et al. | 123/90.31 |
| 5,263,442 | 11/1993 | Hara | 123/90.17 |
| 5,520,145 | 5/1996 | Nagai et al. . | |
| 5,566,651 | 10/1996 | Strauss et al. | 123/90.17 |
| 5,588,404 | 12/1996 | Lichti et al. | 123/90.17 |
| 5,592,909 | 1/1997 | Tsuruta | 123/90.17 |
| 5,592,910 | 1/1997 | Suga et al. | 123/90.17 |

FOREIGN PATENT DOCUMENTS

| | | |
|---|---|---|
| 3-54307 | 3/1991 | Japan . |
| 4-358710 | 12/1992 | Japan . |
| 2080923 | 2/1982 | United Kingdom . |
| 2120320 | 11/1983 | United Kingdom . |
| 2222660 | 3/1990 | United Kingdom . |
| 2228780 | 9/1990 | United Kingdom . |
| 2302391 | 1/1997 | United Kingdom . |
| 2308636 | 7/1997 | United Kingdom . |

*Primary Examiner*—Weilun Lo
*Attorney, Agent, or Firm*—Nixon & Vanderhye, P.C.

[57] ABSTRACT

For enhancing engine startability and reducing discharge of unburned fuel from an engine, a camshaft is rotated toward the most advance side when an exhaust valve is opened. In one aspect, the camshaft is urged toward the advance side with respect to a timing pulley by the urging force of a spring. A stopper is received displaceably in a diametrical direction in a receiving hole and is fitted in a stopper hole when the camshaft is at the most advance position. In another aspect, at engine starting where operating fluid is not supplied to a release fluid chamber, a clutch piston is coupled to a front plate by a spring, and gear teeth of the front plate and the clutch piston are engaged with each other.

10 Claims, 19 Drawing Sheets

VALVE TIMING REGULATION APPARATUS FOR ENGINE

BACKGROUND OF THE INVENTION

1. Field of the Invention

The present invention relates to a valve timing regulation apparatus for an internal combustion engine for regulating opening or closing timing of an intake valve or an exhaust valve of an internal combustion engine.

2. Description of Related Art

In a conventional valve timing regulation apparatus for regulating opening or closing timing (valve timing) of an intake valve or an exhaust valve of an internal combustion engine, drive torque is transmitted from a crankshaft as a drive shaft of the engine to a camshaft as a driven shaft through a drive force transmission member. As the drive force transmission member, for example, a ring-like gear or a vane is employed.

The ring-like gear is engaged with a timing pulley and a spline of the camshaft. At least one of those is engaged with a helical spline. The ring-like gear is moved in an axial direction by fluid pressure whereby the camshaft and the timing pulley are relatively rotated to regulate the valve timing of the intake valve or the exhaust valve according to operating conditions of the engine.

Further, in the vane system disclosed in Japanese Patent Laid-Open No. Hei-1-92504, a housing rotated along with the timing pulley houses therein a vane rotated along with the camshaft. The relative rotation phase difference of the vane with respect to the housing is regulated by fluid pressure to thereby relatively rotate the camshaft and the timing pulley so that the valve timing of the exhaust valve is regulated according to the operating conditions of the engine.

However, in the above conventional valve timing regulating apparatus, the camshaft as the driven shaft receives the force on the retard side with respect to the drive shaft by the drive torque applied to the camshaft for opening and closing the exhaust valve. Accordingly, when the fluid pressure does not operate such as when the engine starts, and at the time of low oil pressure such as when it is idling, the opening timing of the exhaust valve is retarded to sometime overlap the opening timing of the exhaust valve and the opening timing of an intake valve. When the opening timings of the exhaust valve and the intake valve overlap, the combustion gases remained in the cylinder of the engine, i.e., internal exhaust gas recirculation (EGR) amount becomes excessively large, and as a result, the startability of the engine becomes deteriorated, and the engine sometimes becomes disabled to start. Further, there is a problem that the unburned fuel is discharged into exhaust gases.

Further, in the case where the phase difference is regulated by fluid pressure, for example, when the number of revolutions of the engine is low and the discharge pressure of a fluid pump is low, the camshaft cannot be moved toward the advance side with respect to the crankshaft, sometimes resulting in disablement of regulation of the valve timing. Also in the case of the low fluid pressure as described, it is contemplated that a pressure receiving area of fluid pressure is increased to render the regulation of the valve timing possible. However, even if the valve timing can be regulated with low fluid pressure, in the case where the discharge amount and discharge pressure of the fluid pump are sufficient with high rotation of the engine, the flow rate of the operating fluid increases and the time required to change the valve timing increases. That is, a problem arises in that the responsiveness lowers. Further, a problem arises in that the size of the apparatus increases. Further, when the operating fluid pressure is lowered due to the trouble of the fluid pump or the like, the valve timing cannot be regulated, and the engine may be stopped.

Still further, it is necessary to advance the camshaft with respect to the crankshaft at the time of start of the engine and at the time of low load. However, when the camshaft is retarded with respect to the optimum valve timing, the period at which both the exhaust valve and the intake valve are opened increases due to the low rotation and the trouble of the exhaust valve. Then, the exhaust gas remains within the combustion chamber so that the necessary amount of air is not taken into the combustion chamber and the exhaust gas is reversed on the intake side. Further there occurs a problem in that the unburned gas is discharged into the exhaust gas.

As a result, the combustion gas, i.e., internal EGR amount remained in the cylinder of the engine becomes excessively large whereby the combustion is unstable, the noxious component amount contained in the exhaust gas increases, and in the extreme case, the engine stops. At the time of start of the engine, startability becomes worsened.

SUMMARY OF THE INVENTION

It is therefore an object of the present invention to provide a valve timing regulation apparatus for an engine which can enhance the startability of the engine in a simple construction.

It is another object of the invention to provide a valve timing regulation apparatus capable of positively rotating a driven shaft toward an advance side.

According to the first aspect of the present invention, a driven shaft is urged in the direction of advancing with respect to a drive shaft. At the time of starting an engine, the period in which an exhaust valve and an intake valve overlap and open can be reduced to a degree capable of starting the engine. As a result, the startability of the engine can be enhanced, and the fuel taken in from the intake valve and discharged from the exhaust valve unburned can be reduced.

According to the second aspect of the present invention, a one-way clutch for transmitting the drive force of a drive shaft only in a direction of advancing a driven shaft is disposed on a drive force transmission member. In the state where the one-way clutch is coupled, when the driven shaft receives the drive torque on the retard side when the intake valve or the exhaust valve is opened and closed, the driven shaft is prevented from being rotated on the retard side with respect to the drive shaft. Further, when the driven shaft receives the drive torque on the advance side, the driven shaft can be rotated on the advance side with respect to the drive shaft. Accordingly, at the time of start of the engine or at the time of low speed rotation of the engine, it is possible to positively rotate the driven shaft on the advance side with respect to the drive shaft, thus enabling the start of the engine normally and continuing the operating condition of the engine.

DETAILED DESCRIPTION OF THE PREFERRED EMBODIMENTS

Various embodiments of the present invention will be explained with reference to the accompanying drawings. A valve timing apparatus according to the first through tenth embodiments corresponds to the first aspect of the present invention, while the apparatus according to the eleventh to seventeenth embodiments corresponds to the second aspect of the invention. The apparatus according to those embodiments are designed to regulate valve timing of an exhaust valve of an engine.

(First Embodiment)

Figure 1:
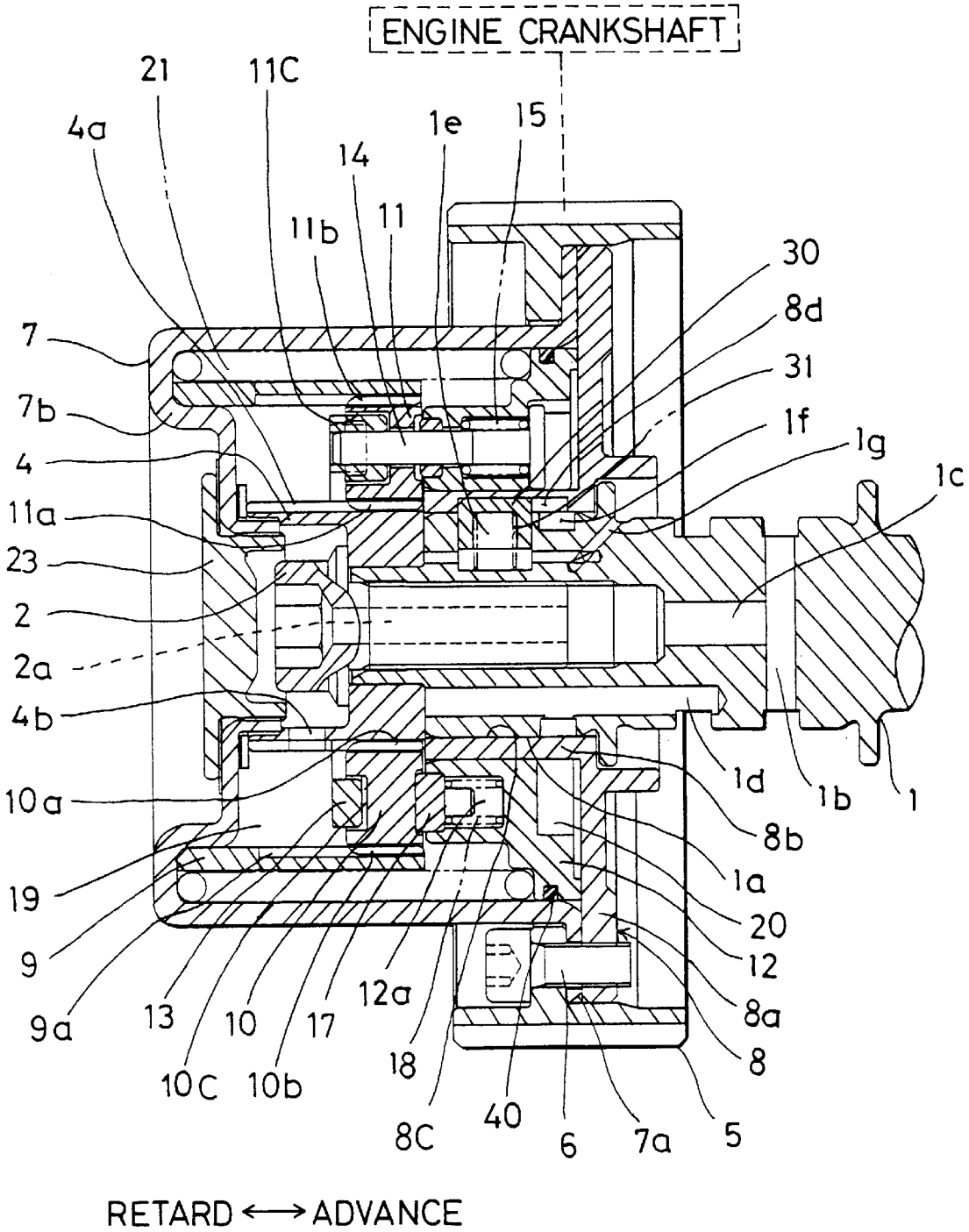
FIG. 1 is a longitudinal sectional view showing a valve timing regulation apparatus according to the first embodiment.

In FIG. 1 showing the valve timing regulation apparatus for the engine according to the first embodiment of the present invention, the rotational torque is transmitted from a crankshaft as a drive shaft to a timing pulley 5 as the drive-side rotor by means of a timing belt.

A cylindrical camshaft sleeve 4 is secured to one end of a camshaft 1 by means of a bolt 2 rotated integrally with the camshaft 1 as the driven shaft and a pin not shown. An outer tooth helical spline 4*a* is formed in a part of an outer peripheral wall of the camshaft sleeve 4 as the driven-side rotor. A timing pully 5 and the camshaft 1 rotate clockwise as viewed from the left in FIG. 1.

A sprocket sleeve 7 and a flange member 8 constitute the drive-side rotor together with the timing pulley 5. An annular portion 7*a* and an annular portion 8*a* are mounted on the timing pulley 5 by means of a bolt 6. The flange member 8 is formed integrally with the annular portion 8*a* and a cylindrical portion 8*b*. An inner surface 8*c* of the cylindrical portion 8*b* is supported on the outer peripheral wall 1*a* of the camshaft 1 so that the timing pulley 5 is relatively rotatably supported on the camshaft 1.

A cylindrical member 9 is secured to an inner tube 7*b* of the sprocket sleeve 7 by welding or the like, and an inner tooth helical spline 9*a* is formed in an inner peripheral wall of the cylindrical member 9. Two circular gears 10 and circular gears 11 for relatively rotating the timing pulley 5 and the camshaft 1 are interposed between the diametrical directions of the camshaft sleeve 4 and the cylindrical member 9. The circular gears 10 and 11 as the drive force transmission means are formed by dividing a single ring-like gear into divided surfaces including a shaft. When the circular gear 10 and circular gear 11 are moved toward the advance side indicated by the arrow in FIG. 1, the camshaft 1 is retarded relative to the timing pulley 5. The circular gears 10, 11 are alternately mounted in the peripheral direction on a piston 12 to constitute a single ring-like gear. The circular gears 10, 11 are formed in their upper ends with circular grooves 10*c*, 11*c*, and a retainer ring 13 is received in the grooves 10*c*, 11*c*. In the state shown in FIG. 1, the retainer ring 13 is not in contact with the circular gear 10 in the axial direction. The circular gears 10, 11, the periphery of the piston 12 and a receiving hole 12*a* are filled with oil.

The receiving hole 12*a* is formed at a position corresponding to the circular gear 10 of the piston 12. A spring 18 is received in the receiving hole 12*a* to urge an annular member 17 and the circular gear 10 leftward in FIG. 1, that is, in the direction away from the piston 12.

A pin 14 extends through the piston 12 and the circular gear 11 in a manner capable of being reciprocated and extends through an annular member 17 slidably. Since the pin 14 is pressed into the retainer ring 13, both the retainer ring 13 and the pin 14 move to constitute a part of the drive force transmission means. Since the pin 14 is urged rightward in FIG. 1 by the urging force of the spring 15, the retainer ring 13 and the circular gear 11 are also urged rightward in FIG. 1, that is, in the direction close to the piston 12 in the direction opposite to the urging direction of the circular gear 10 by the spring 18.

The circular gears 10, 11 are formed in the inner peripheral walls with internal tooth helical splines 10*a*, 11*a* and formed in the outer peripheral wall with external tooth helical splines 10*b*, 11*b*. The axial movement of the circular gears 10, 11 can be made in the compressed range of the springs 18 and 15. Since the circular gears 10, 11 are urged in the direction away from each other, the axial position of the external tooth helical splines 10*b*, 11*b*, and the internal tooth helical splines 10*a*, 11*a* is further deviated from that shown in FIG. 1 in the state before the circular gears 10, 11 are intervened between the cylindrical member 9 and the camshaft sleeve 4.

When the circular gears 10, 11 are intervened between the cylindrical member 9 and the camshaft sleeve 4, the circular gears 10, 11 are slightly moved in the axial direction and in the rotational direction of the camshaft 1 by the amount for absorbing the backlash between the splines and intervened between the cylindrical member 9 and the camshaft sleeve 4 with the axial deviation made smaller than the state before the intervention. The spring 18 and the spring 15 urge the circular gears 10, 11 in the direction opposite to the axial direction relative to the piston 12. This urging force imparts the torque such that the circular gear 10 and the circular gear 11 cause the camshaft 1 to relatively move in the retard direction relative to the timing pulley 5 and the camshaft 1 in the advance direction relative to the timing pulley 5, respectively. That is, by the urging force of the spring 18, the external tooth helical spline 10*b* of the circular gear 10 causes the internal tooth helical spline 9*a* of the cylindrical member 9 to press in the retard direction, and the internal tooth helical spline 10*a* causes the external tooth helical spline 4*a* of the camshaft 4 to press in the retard direction. By the urging force of the spring 15, the external tooth helical spline 11*b* of the circular gear 11 causes the internal tooth helical spline 9*a* of the cylindrical member 9 to press in the advance direction, and the internal tooth helical spline 11*a* causes the external tooth helical spline 4*a* of the camshaft 4 to press in the advance direction. Accordingly, the circular gears 10, 11 are applied with the torque which resists the positive and negative drive torques received by the camshaft 1 when the exhaust valve is opened and closed by the urging force of the springs 18, 15 so that the tooth striking noise caused by the backlash between the splines can be suppressed. By the engagement of the splines as described above, the rotation of the timing pulley 5 is transmitted to the camshaft 1 through the sprocket sleeve 7, the cylindrical member 9, the circular gears 10, 11, and the camshaft sleeve 4.

A spring 21 as the first urging means is received between the sprocket sleeve 7 and the cylindrical member 9 to urge the piston 12 rightward in FIG. 1, that is, toward the advance side. Since the circular gears 10, 11 and the piston 12 are urged rightward in FIG. 1 by the urging force of the spring 21, the camshaft 1 is urged toward the advance relative to the timing pulley 5 through the camshaft sleeve 4.

As previously mentioned, the spring 15 presses the circular gear 11 in the direction of the advance whereby the camshaft sleeve 4 and the camshaft 1 are urged in the direction of advance. That is, the spring 15 constitutes a part of the first urging means. The sum of the urging forces by which the spring 15 and the spring 21 urge the camshaft 1 toward the advance is set to be greater than the maximum torque transmitted by the drive shaft at the time of cranking when the engine starts. Accordingly, the urging force of the spring 21 can be made smaller as compared with the case where the spring 15 is not present. In the above construction, the biasing force of the spring 18 is set smaller than that of the spring 15. By this setting, when the camshaft 1 moves in the advance direction relative to the timing pulley 5, the friction force caused by the spring 18 in the retard direction can be reduced and the camshaft 1 can be relatively moved smoothly in the advance direction.

A stopper 30 is formed to be closed-end cylindrical, and is received displaceably in a diametrical direction into a receiving hole 1*e* opened to the outer peripheral wall of the camshaft 1. The stopper 30 is urged externally in the diametrical direction by means of a spring 31 as the second urging means. A stopper hole 8*d* is formed in the inner peripheral wall of the cylindrical portion 8*b* of the flange member 8, and when the camshaft 1 is at the most advance position relative to the timing pulley 5, the stopper 30 can be fitted in the stopper hole 8*d*. FIG. 1 shows the state where the stopper 30 is fitted in the stopper hole 8*d*. The stopper hole 8*d* is in communication with an annular oil path if, which is in turn in communication with an oil path 1*d*. Since the oil path 1*f* is in communication with a retard hydraulic chamber 20 through an oil path not shown, a fitting hole 8*d* is to be communicated with the retard hydraulic chamber 20. A communication path 1*g* is released to atmosphere so as not to impede the movement of the stopper 30.

An advance hydraulic chamber 19 and a retard hydraulic chamber 20 are formed on the left-hand of the piston 12 and on the right-hand of the piston 12, respectively. The advance hydraulic chamber 19 and the retard hydraulic chamber 20 are liquid-sealed by a bolt 23 and the flange member 8 and are substantially liquid-sealed by the cylindrical portion 8*b* of the flange member 8. The advance hydraulic chamber 19 and the retard hydraulic chamber 20 are isolated from each other by a seal member 40 made of resin fitted in the outer periphery of the piston 12.

By the switching control of a hydraulic control valve not shown, the flow of a supply of pressure oil to the oil path leading to the advance hydraulic chamber 19 and the retard hydraulic chamber 20 and a discharge of pressure oil from the oil path is controlled. More specifically, the oil path 4*b* formed in the camshaft sleeve 4 leading to the advance hydraulic chamber 19, the oil path 2*a* constituted in the bolt 2, the oil paths 1*c*, 1*b* formed in the camshaft 1 and the main pump side or the drain side are placed in conduction or cutoff by switching the hydraulic control valve to control the oil pressure within the advance hydraulic chamber 19. Further, the oil path not shown leading to the retard hydraulic chamber 20, the oil paths 1*f*, 1*d* formed in the camshaft 1 and the main pump side or the drain side are placed in conduction or cutoff by switching the hydraulic control valve to control the oil pressure within the retard hydraulic chamber 20. The circular gears 10, 11 and the piston 12 can be axially moved or stopped under the balance of oil pressures of the advance hydraulic chamber 19 and the retard hydraulic chamber 20 to control a relative phase difference of the camshaft 1 relative to the timing pulley 5.

Next, the operation of the valve timing regulation apparatus will be explained.

Figure 2A:
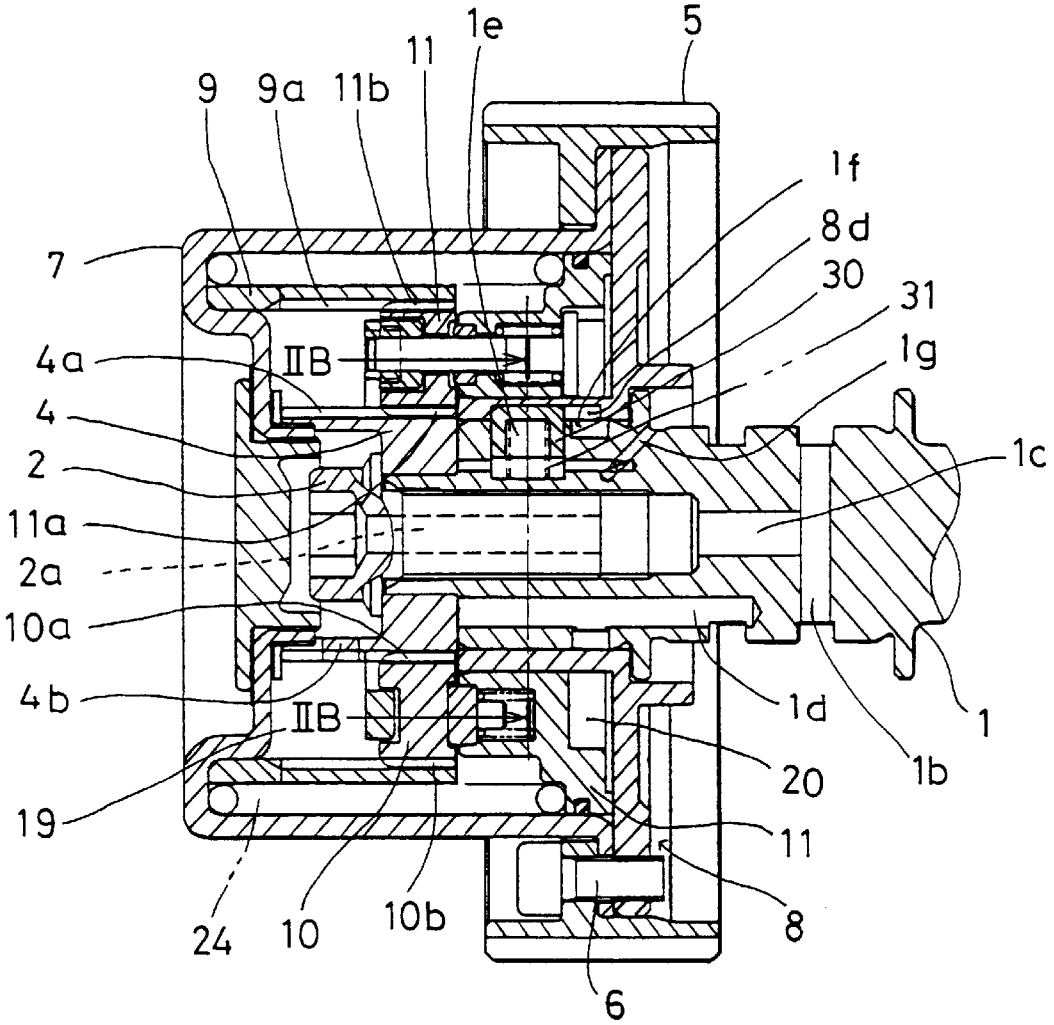
FIG. 2A is a longitudinal sectional view at the most advance position in the first embodiment.
Figure 2B:
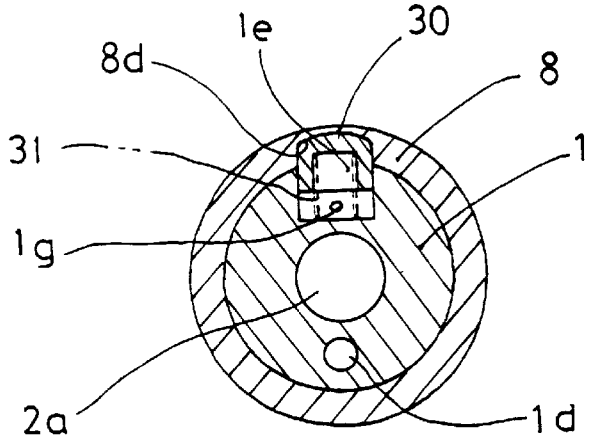
FIG. 2B is a sectional view taken on line IIB—IIB in FIG. 2A.

1. When the engine normally stops (1-1) When the engine normally stops, the oil paths 4*b*, 2*a*, 1*c*, 1*b* in communication with the advance hydraulic chamber 19 are held in the state where the operating fluid pressure is applied, and the hydraulic control valve is switched so that the oil path 1*d* in communication with the retard hydraulic chamber 20 is released to the drain side. Accordingly, the circular gears 10, 11 together with the piston 12 are moved rightward in FIG. 1, and the camshaft 1 stops at the most advance position relative to the timing pulley 5 as shown in FIGS. 2A and 2B. At this time, since the fitting hole 8*d* is also released to the drain side, the stopper 30 is fitted in the stopper hole 8*d* by the urging force of the spring 31. The camshaft 1 and the flange member 8 are coupled by the stopper 30, and the camshaft 1 as the driven shaft is positively held at the most advance position with respect to the crankshaft as the drive shaft.

(1-2) In the first embodiment, it is designed so that in the most advance state shown in FIGS. 2A and 2B, the opening periods of the exhaust valve and the intake valve do not overlap. Therefore, the combustion gases remained in the cylinder of the engine, so-called internal EGR amount can be reduced, and the engine starts normally. Even if the engine starts, the stopper 30 remains fitted in the stopper hole 8*d* by the urging force of the spring 31 till the operating oil is introduced into the oil paths and the hydraulic chambers and the oil pressure of the oil path 1*d* exceeds a predetermined operating oil pressure.

When the camshaft 1 is subjected to cranking in the most advance position with respect to the crankshaft, and the engine normally starts the operation, the oil pressure of the oil paths 1*d*, 1*f* rises to a predetermined operating oil pressure, and the stopper 30 comes out of the stopper hole 8*d* against the urging force of the spring 31 by the force received from oil pressure in the stopper hole 8*d*. Since the coupling state between the camshaft 1 and the flange member 8 is released, the timing pulley 5 and the camshaft 1 can be relatively moved. The circular gears 10, 11 and the piston 12 are axially reciprocated, irrespectively of the urging force of the spring 21, by the operating oil pressure applied to the advance hydraulic chamber 19 and the retard hydraulic chamber 20 so that the relative phase difference of the camshaft 1 with respect to the timing pulley 5 is regulated.

2. When the engine abnormally stops

Figure 3A:
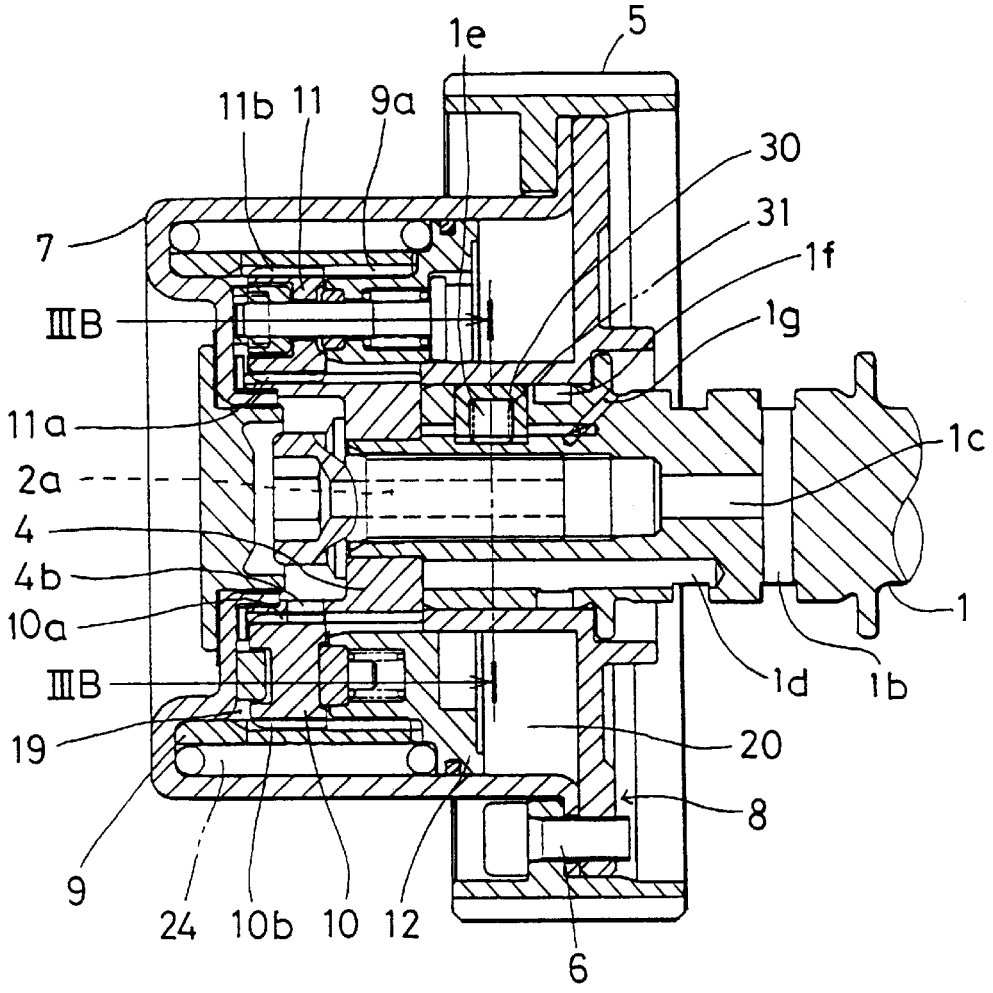
FIG. 3A is a longitudinal sectional view showing the state where a stopper is released in the first embodiment.
Figure 3B:
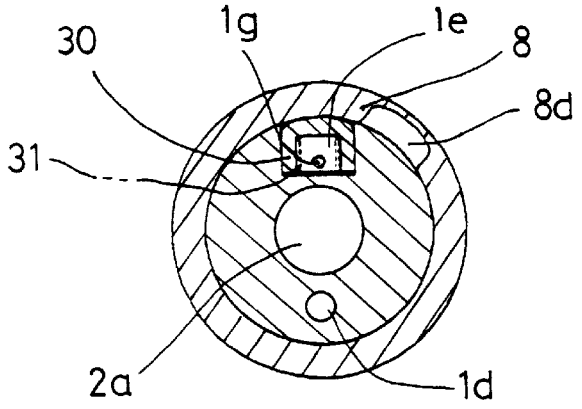
FIG. 3B is a sectional view taken on line IIIB—IIIB in FIG. 3A.

In the case where the engine abnormally stops, the hydraulic control is disconnected halfway. However, since the sum of the urging forces of the spring 15 and the spring 21 is greater than the maximum torque at the time of cranking when the engine starts, as described above, the camshaft 1 moves to the most advance position. When the camshaft 1 moves to the most advance position, the stopper 30 is fitted in the fitting hole 8*d* so that the camshaft 1 and the flange member 8 are positively coupled at the most advance position. When the engine normally starts the operation, the oil pressure of the oil paths 1*d*, 1*f* rises to a predetermined operating oil pressure, and the stopper 30 comes out of the stopper hole 8*d* against the urging force of the spring 31 by the force received from the oil pressure in the stopper hole 8*d* as shown in FIGS. 3A and 3B. When the stopper 30 comes out of the stopper hole 8*d*, the relative rotation control of the camshaft 1 with respect to the timing pulley 5 becomes enabled. FIGS. 3A and 3B show the state where the stopper 30 comes out of the stopper hole 8*d*, and the camshaft 1 is at the most retard position with respect to the timing pulley 5.

In the above first embodiment, the camshaft 1 is held at the most advance position with respect to the crankshaft, when the engine starts, irrespective of the fact that the engine normally stops or abnormally stops, and therefore, the engine positively starts and shifts into the normal operating condition. Accordingly, the startability of the engine is enhanced, and the unburned fuel is not discharged into the exhaust gas, thus enhancing the purifying effect of the exhaust gas.

Further, in the first embodiment, the circular gears 10, 11 are urged in the direction opposite to the shafts and in the direction away from each other through the piston 12 by the urging force of the springs 18 and 15. Therefore, on the cylindrical member 9 side, the external tooth helical splines, 10*b*, 11*b* apply the torque in the opposite direction to the internal tooth helical spline 9*a* into contact therewith, whereas on the cylindrical member 9 side, the internal tooth helical splines 10*a*, 11*a* apply the torque in the opposite direction to the external tooth helical spline 4*a* into contact therewith. For this reason, even if the torque is varied in the direction reversed to the rotational direction (positive torque) or in the same direction as the rotational direction (negative torque), the tooth striking noise caused by the backlash of the helical splines can be suppressed.

While in the first embodiment, the locking mechanism couples the flange member 8 and the camshaft 1 in the diametrical direction, it is to be noted that the locking mechanism can be constituted to couple the flange member 8 and the camshaft 1 in the axial direction.

(Second Embodiment)

Figure 4:
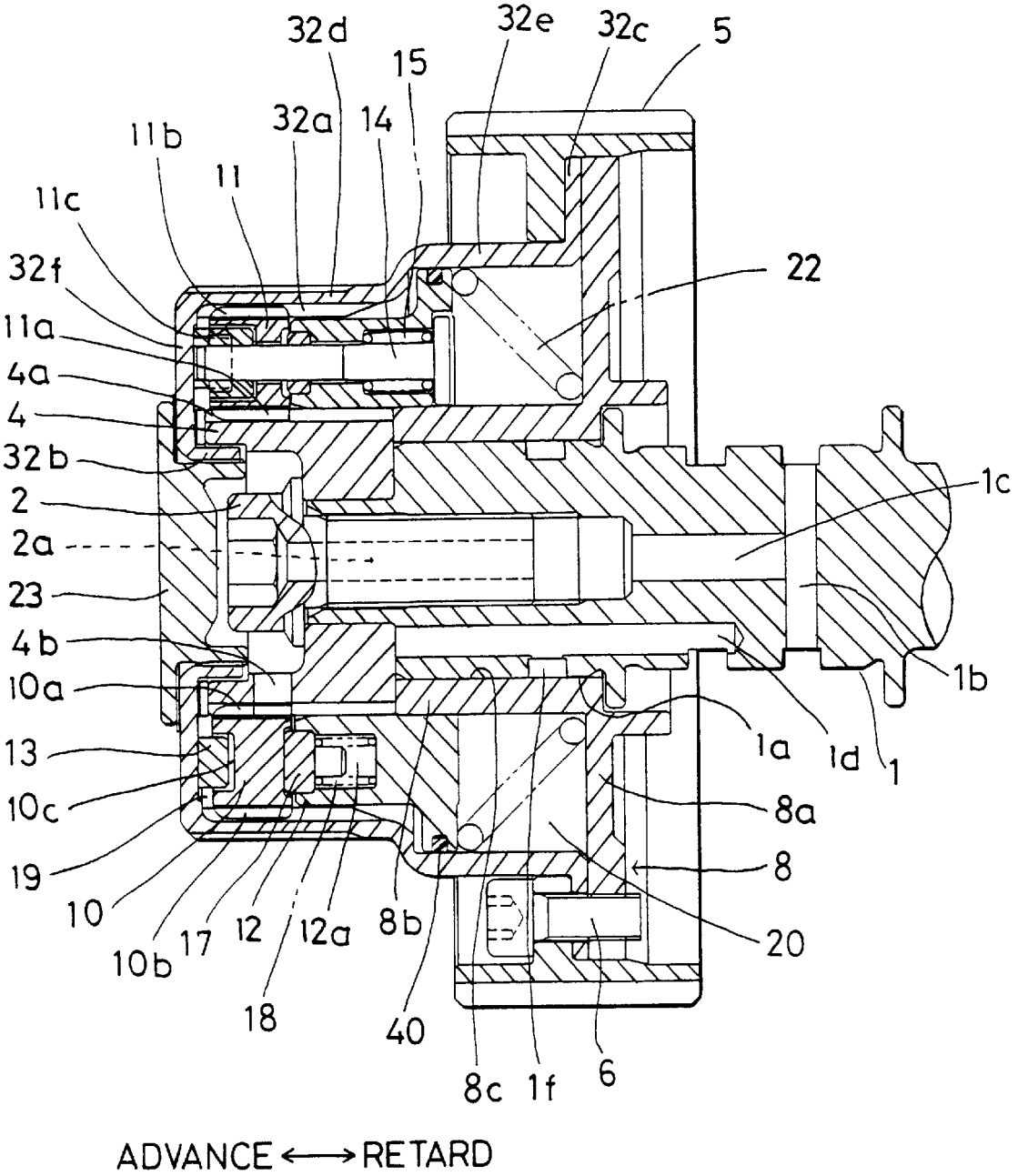
FIG. 4 is a longitudinal sectional view showing a valve timing regulation apparatus according to the second embodiment.

In FIG. 4 showing the second embodiment of the present invention, substantially the same constituent parts as those of the first embodiment are indicated by the same reference numerals. In the second embodiment, the helical splines are formed in the torsional direction opposite to the first embodiment.

A sprocket sleeve 32 as the drive-side rotor is mounted together with the flange member 8 on the timing pulley 5 by means of the bolt 6. The sprocket sleeve 32 is formed integrally with an outer tube having a small diameter portion 32*d* and a large diameter portion 32*e*, an annular flange portion 32*c* extending externally in a diametrical direction from the small diameter portion side opposite to the large diameter portion 32*e*, an inner tube 32*b*, and an annular portion 32*f* extending internally in a diametrical direction from the large diameter portion side opposite to the small diameter portion 32*d* and coupling the outer tube and the inner tube 32*b*. An internal tooth helical spline 32*a* is formed in a part of the inner peripheral wall of the small diameter portion 32*d*. This internal tooth helical spline 32*a* engages the external tooth helical splines 10*a*, 11*a* of the circular gears 10, 11.

The spring 22 as the first urging means is received in a conical shape between the piston 12 and the flange member 8 to urge the piston 12 leftward in FIG. 4, that is, toward the advance side. It is designed so that the sum of the urging forces of the spring 22 and the spring 18 is greater than the maximum torque when the engine starts. That is, the spring 18 constitutes a part of the first urging means. Accordingly, the urging force of the spring 22 can be made smaller as compared with the case where the spring 18 is not present. Further, even if where at the time of start of the engine, the cam shaft 1 is not at the most advance position with respect to the crankshaft, the camshaft 1 is caused to move to the most advance position to assume the normal operation, and the occurrence of the tooth striking noise caused by the backlash between the helical splines can be prevented.

In the second embodiment, the hydraulic chamber 19 is the retard hydraulic chamber, and the hydraulic chamber 20 is the advance hydraulic chamber.

Further, although the stopper and the spring as the locking mechanism are not shown, the configuration similar to that of the first embodiment is provided. The fitting hole in which the stopper is fitted is communicated with the retard hydraulic chamber 19.

(1) When the engine normally stops, the oil paths 4*d*, 2*a*, 1*c*, 1*b* in communication with the retard hydraulic chamber 19 is released to the drain side, and the hydraulic control valve is switched so that the oil paths 1*f*, 1*d* in communication with the retard hydraulic chamber 19 are held in the state applied with the operating oil pressure. Accordingly, the circular gears 10, 11 and the piston 12 are moved leftward in FIG. 4, that is, to the most advance position. When the camshaft 1 relatively rotates to the most advance position as the circular gears 10, 11 and the piston 12 move to the most advance position, the camshaft 1 and the flange member 8 are coupled by the locking mechanism so that the camshaft 1 is held at the most advance position relative to the timing pulley 5.

(2) Even if the engine starts, the camshaft 1 and the flange member 8 remain coupled by the locking mechanism till the operating oil is introduced into the oil paths 4*d*, 2*a*, 1*c*, 1*b* and the operating oil pressure exceeds a predetermined pressure.

When the operating oil pressure of the oil paths 4*d*, 2*a*, 1*c*, 1*b* exceeds a predetermined pressure, the coupling between the camshaft 1 and the flange member 8 is released by the locking mechanism, thus enabling the relative rotation of the timing pulley 5 and the camshaft 1. The circular gears 10, 11 and the piston 12 are axially reciprocated, irrespective of the urging force of the spring 12, by the operating pressure applied to the retard hydraulic chamber 19 and the advance hydraulic chamber 20 to regulate the relative phase difference of the camshaft 1 with respect to the timing pulley 5.

Even if the engine abnormally stops, the engine shifts to the normal operating state, similarly to the first embodiment.

Accordingly, also in the second embodiment, it is possible to prevent the opening period of the exhaust valve from overlapping the opening period of the intake valve when the engine starts, irrespective of the fact that the engine normally stops or abnormally stops, similar to the first embodiment, thus enabling the reduction in the internal EGR amount. Accordingly, the startability of the engine is enhanced, and the unburned fuel is not discharged into the exhaust gas, thus enhancing the purifying effect of the exhaust gas.

(Third Embodiment)

Figure 5:
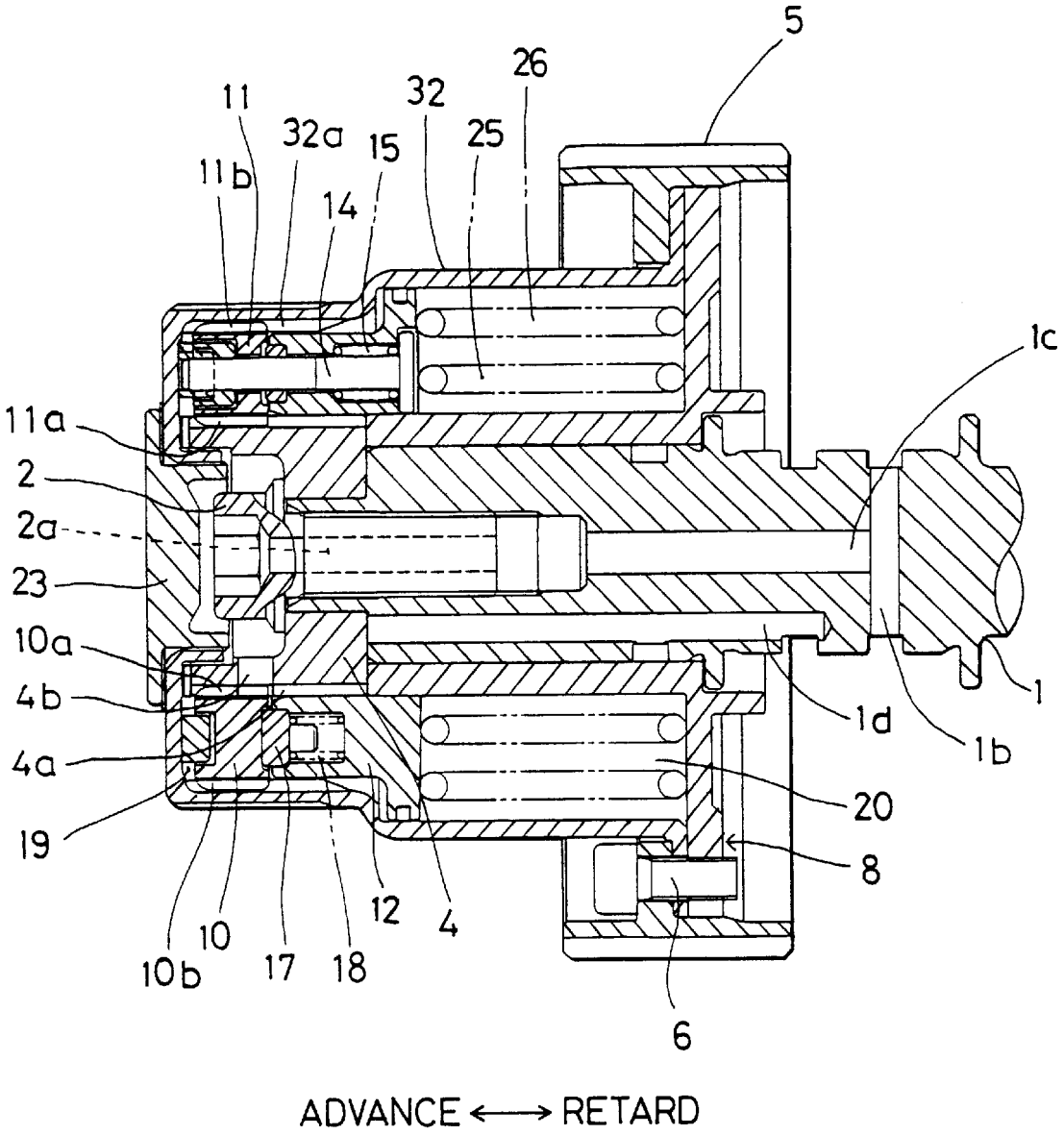
FIG. 5 is a longitudinal sectional view showing a valve timing regulation apparatus according to the third embodiment.

In FIG. 5 showing the third embodiment of the present invention, substantially the same constituent parts as those of the first embodiment are indicated by the same reference numerals. The helical splines are formed in the torsional direction opposite to the first embodiment.

In the third embodiment, a small diameter spring 25 is disposed in the outer periphery of the flange member 8, and a large diameter spring 26 larger than the small diameter spring 25 is disposed in the outer periphery of the small diameter spring 25. Both springs as the first urging means urge the piston 12 toward the advance. It is designed so that the sum of the urging forces of the small diameter spring 25, the large diameter spring 26 and the spring 18 is greater than the maximum torque at the time of start of the engine. Accordingly, as compared with the case where the spring 18 is not present, the sum of the urging forces of the small diameter spring 25 and the large diameter spring 26 can be made small. Further, even if at the time of start of the engine, the camshaft 1 is not at the most advance position with respect to the crankshaft, the camshaft 1 can be moved to the most advance angle to shift to the normal operation, and the tooth striking noise caused by the backlash between the helical splines can be prevented from occurring. Other configurations are the same as those mentioned in the second embodiment. Accordingly, the hydraulic chamber 19 is the retard hydraulic chamber similar to the second embodiment, and the hydraulic chamber 20 is the advance hydraulic chamber.

Further, although not shown, there is provided the locking mechanism capable of coupling the flange member 8 with the camshaft 1, similar to the first embodiment.

In the third embodiment, the provision of two springs as the first urging means can reduce the urging force of each spring. If the design can be made, the number of springs may be three or more.

(Fourth Embodiment)

Figure 6:
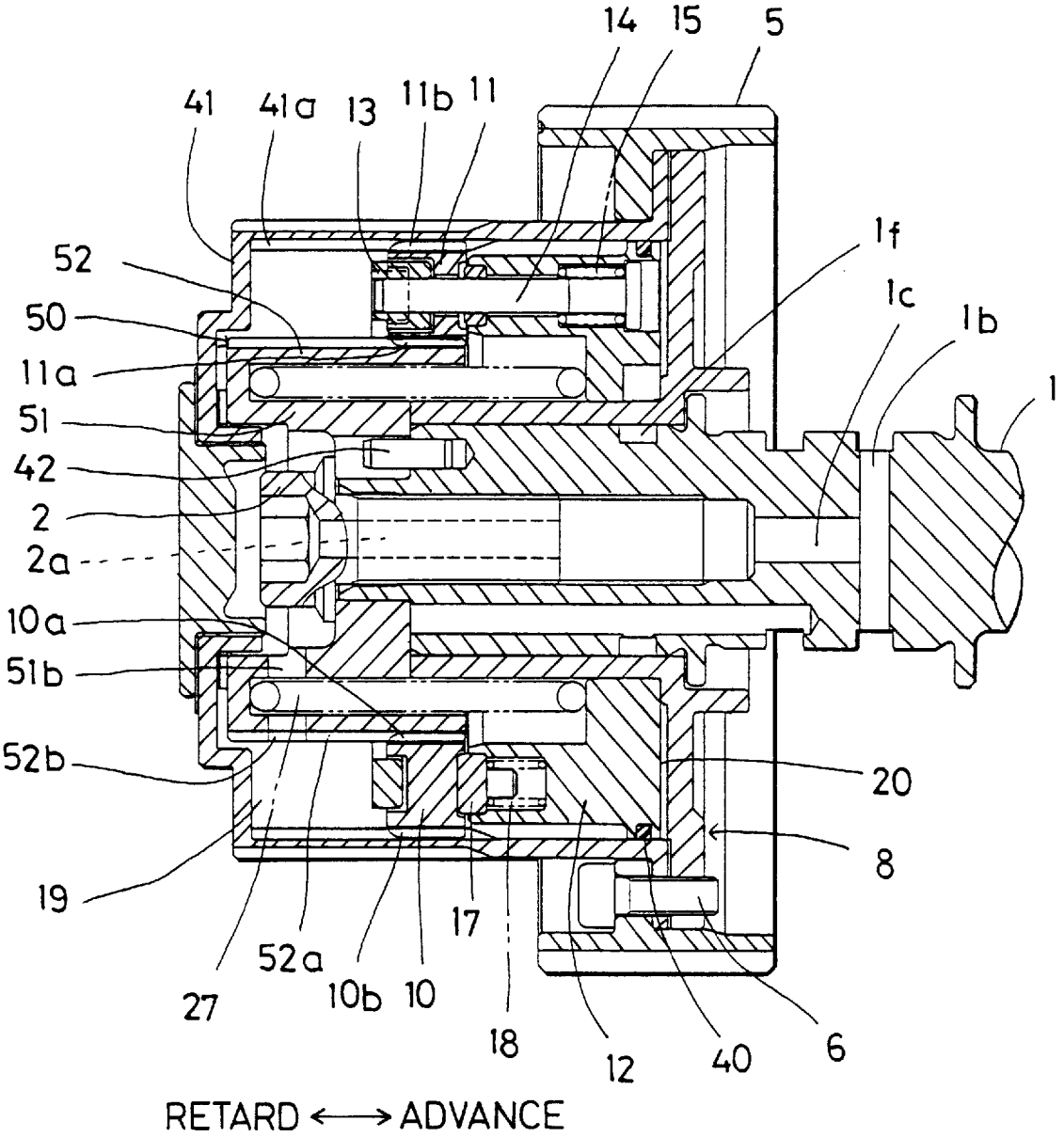
FIG. 6 is a longitudinal sectional view showing a valve timing regulation apparatus according to the fourth embodiment.

In FIG. 6 showing the fourth embodiment of the present invention, substantially the same constituent parts as those of the first embodiment are indicated by the same reference numerals. The helical splines are formed in the torsional direction opposite to the first embodiment.

A sprocket sleeve 41 as the drive-side rotor and the flange member 8 are mounted on the timing pulley 5 by means of the bolt 6. An internal helical spline 41*a* is formed in the inner peripheral wall of the sprocket sleeve 41 and engages the external tooth helical splines 10*b*, 11*b* of the circular gears 10, 11.

A camshaft sleeve 50 is secured to one end of the camshaft 1 by means of the bolt 2 and a pin 42. The camshaft sleeve 50 comprises an inner ring 51 and an outer ring 52, and an external tooth helical spline 52*a* is formed in the outer peripheral wall of the outer ring 52. The external tooth helical spline 52*a* engages the internal tooth helical splines 10*a*, 11*a* of the circular gears 10, 11. The oil path 2*a* is communicated with the advance hydraulic chamber 19 by communication holes 51*b*, 52*b* formed in the inner ring 51 and the outer ring 52, respectively.

The spring 27 as the first urging means is received between the inner ring 51 and the outer ring 52 to urge the piston 1 toward the advance. It is designed so that the sum of the urging forces of the spring 27 and the spring 15 is greater than the maximum torque at the time of start of the engine. Accordingly, as compared with the case where the spring 15 is not present, the urging force of the spring 27 can be reduced. Further, even in the case where at the time of start of the engine, the camshaft 1 is not at the most advance position with respect to the crankshaft, the camshaft 1 can be moved to the most advance angle to shift to the normal operation, and the tooth striking noise caused by the backlash between the helical splines can be prevented from occurring.

The inclination of the helical splines is the same as that of the first embodiment. That is, when the circular gears 10, 11 are moved leftward in FIG. 6, the camshaft 1 rotates toward the retard side with respect to the timing pulley 5, and when the circular gears 10, 11 are moved rightward in FIG. 6, the camshaft 1 rotates toward the advance side with respect to the timing pulley 5. Accordingly, the hydraulic chamber 19 is the advance hydraulic chamber in the fourth embodiment, and the hydraulic chamber 20 is the retard hydraulic chamber in the fourth embodiment.

Further, although not shown, there is provided the locking mechanism capable of coupling the flange member 8 with the camshaft 1, similar to the first embodiment.

While in the first to fourth embodiments as explained above, the ring-like gear is divided in the plane including the shaft to form the circular gears, it is to be noted that the ring-like gear can be divided in the plane perpendicular to the shaft to form the circular gears.

(Fifth Embodiment)

Figure 7:
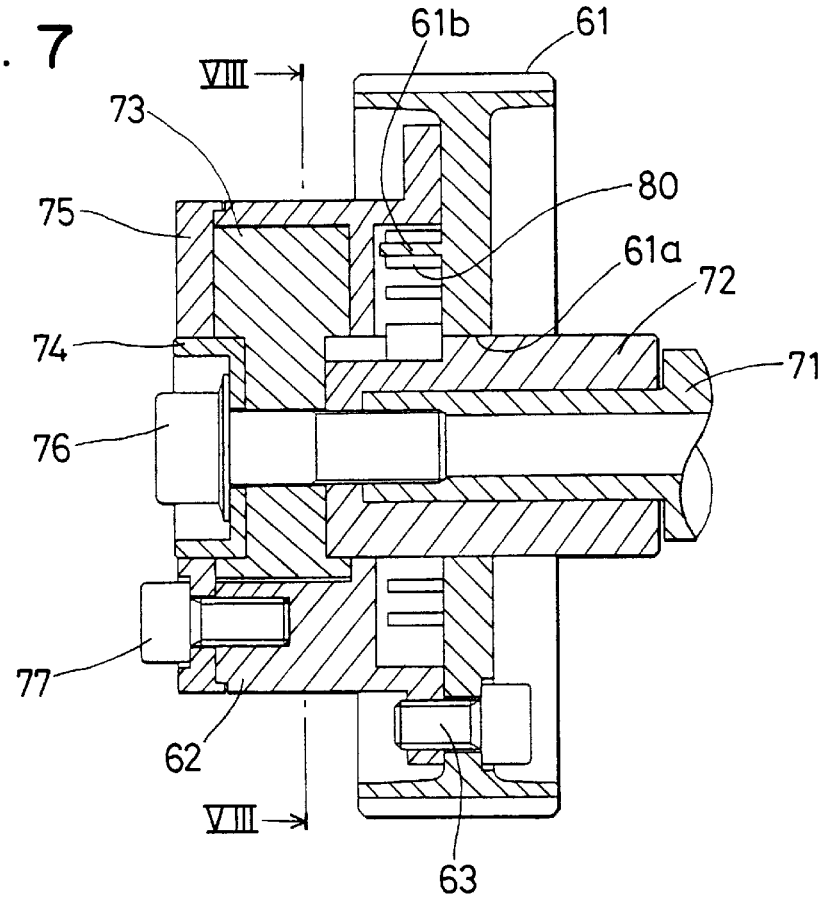
FIG. 7 is a longitudinal sectional view showing a valve timing regulation apparatus according to the fifth embodiment.
Figure 8:
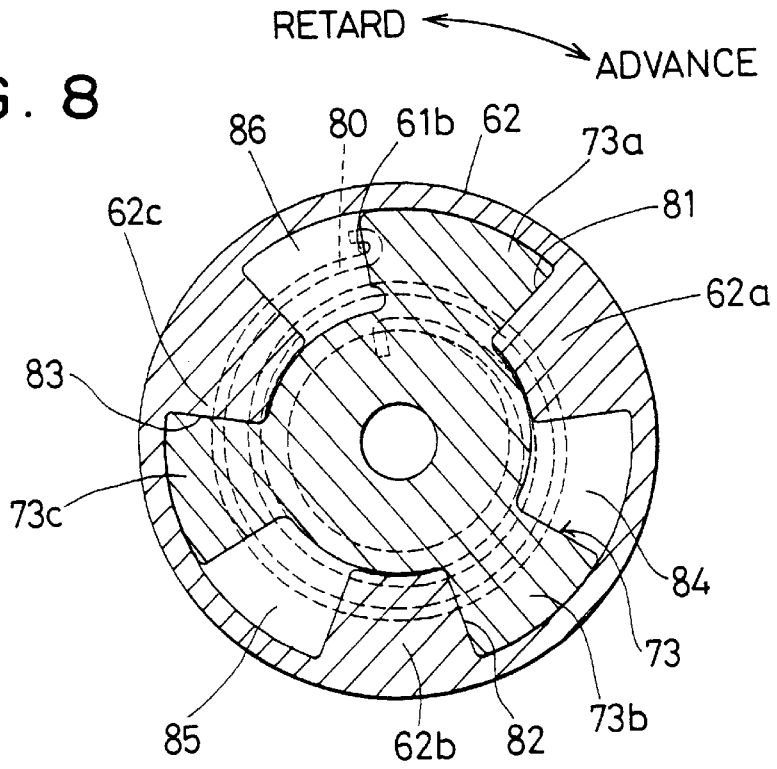
FIG. 8 is a sectional view taken on line VIII—VIII in FIG. 7.

In FIGS. 7 and 8 showing the fifth embodiment of the present invention, to a timing pulley 61 is transmitted the drive force from the crankshaft as the drive shaft of the engine not shown by a timing belt not shown, and the timing pulley 61 rotates in synchronism with the crankshaft. To a camshaft 71 as the driven shaft is transmitted the drive force from the timing pulley 61 to open and close the exhaust valve not shown. The camshaft 71 can rotate at a predetermined phase difference with respect to the timing pulley 61. The timing pulley 61 and the camshaft 71 rotate clockwise as viewed from left side in FIG. 7. Hereinafter, this rotation direction will be the advance.

As shown in FIG. 7, the timing pulley 61 and a shoe housing 62 are coaxially secured by means of a bolt 63, and the shoe housing 62 and a front plate 75 are coaxially secured by means of a bolt 77. The timing pulley 61, the shoe housing 62 and the front plate 75 constitute a drive-side rotor, and an inner peripheral wall 61*a* of the timing pulley 61 is fitted relatively rotatably in the outer peripheral wall of the camshaft sleeve 72.

The camshaft 71, the camshaft sleeve 72, a vane rotor 73 and a cylindrical projecting portion 74 are coaxially secured by means of a bolt 76. The camshaft sleeve 72, the vane rotor 73 and the cylindrical projecting portion 74 constitute a driven-side rotor.

A spiral spring 80 as the first urging means is disposed in the outer periphery of the camshaft sleeve 72, one end of which is secured to a stop portion 61*b* of the timing pulley 61 while the other end is secured to the camshaft sleeve 72. The spiral spring 80 urges the vane rotor 73 toward the advance shown in FIG. 8 with respect to the shoe housing 62. FIG. 8 shows the state where the vane rotor 73 is at the most advance position with respect to the shoe housing 62. It is designed that the urging force of the spiral spring 80 is greater than the maximum torque at the time of start of the engine.

The shoe housing 62 has diametrically internally projecting trapezoidal shoes 62*a*, 62*b* and 62*c*. The inner peripheral surfaces of the shoes 62*a*, 62*b* and 62*c* are formed to be circular in section, and semicircular space portions as receiving chambers for vanes 73*a*, 73*b* and 73*c* are formed in three peripheral gaps of the shoes 62*a*, 62*b* and 62*c*.

The vane rotor 73 has the semicircular vanes 73*a*, 73*b* and 73*c* disposed at equi-intervals in the peripheral direction, which are rotatably received in the semicircular space portions formed in the peripheral gaps of the shoes 62*a*, 62*b* and 62*c*. A fine clearance is provided between the outer peripheral wall of the vane rotor 73 and the inner peripheral wall of the shoe housing 62, and the vane rotor 73 can be rotated relatively to the shoe housing 62. A retard hydraulic chamber 81 is formed between the shoe 62*a* and the vane 73*a*, a retard hydraulic chamber 82 is formed between the shoe 62*b* and the vane 73*b*, and a retard hydraulic chamber 83 is formed between the shoe 62*c* and the vane 73*c*. Further, an advance hydraulic chamber 84 is formed between the shoe 62*a* and the vane 73*b*, an advance hydraulic chamber 85 is formed between the shoe 62*b* and the vane 73*c*, and an advance hydraulic chamber 86 is formed between the shoe 62*c* and the vane 73*a*.

Although not shown, an axially displaceable stopper is received in the vane rotor 73, and the stopper can be fitted in a stopper hole formed in a front plate 75. The fitting of the stopper in the stopper hole is made when the camshaft 71 is at the most advance position with respect to the crankshaft, and the stopper is fitted in the stopper hole whereby the front plate 75 and the vane rotor 73 are coupled. This assumes a state where the camshaft 71 is held at the most advance position with respect to the crankshaft.

With the above-described construction, the camshaft 71 and the vane rotor 73 can be coaxially and relatively rotated to the timing pulley 61, the shoe housing 62 and the front plate 75.

The operation of the valve timing regulation apparatus will be explained below.

(1) When the engine normally stops, the retard hydraulic chambers 81, 82 and 83 are released to the drain side, and a hydraulic control valve not shown is switched so that operating oil pressure is applied to the advance hydraulic chambers 84, 85 and 86. Then, the vane rotor 73 moves to the most advance position with respect to the shoe housing 62, and the front plate 75 is coupled to the vane rotor 73 by the locking mechanism so that the camshaft 71 is held at the most advance position with respect to the timing pulley 61.

(2) In the fifth embodiment, it is designed so that in the most advance state shown in FIG. 8, the opening periods of the exhaust valve and the intake valve do not overlap. Therefore, the internal EGR amount can be reduced, and the engine normally starts. Even if the engine starts, the state is maintained in which the front plate 75 and the vane rotor 73 are coupled by the locking mechanism till the operating oil pressures applied to the oil paths and the hydraulic chambers exceed a predetermined pressure. Therefore, the camshaft 71 is at the most advance position with respect to the timing pulley 61.

When the engine shifts to the normal operation and operating pressure oil higher than a predetermined pressure is introduced into the oil paths and the hydraulic chambers, the coupling between the front plate 75 and the vane rotor 73 by the locking mechanism is released. Accordingly, the vane rotor 73 is rotated relative to the shoe housing 62, irrespective of the urging force of the spiral spring 80, by the operating oil pressures applied to the retard hydraulic chambers 81, 82, 83, and the advance hydraulic chambers 84, 85, 86 to regulate the relative phase difference of the camshaft 71 to the timing pulley 61.

In case the engine abnormally stops, the urging force on the advance side is greater than the maximum torque at the time of start of the engine, the vane rotor 73 stops in the state it is held at the most advance side by the urging force on the advance side. Therefore, the engine can start normally at the time of re-start without the locking mechanism, and the occurrence of collision noise between the shoe and the vane can be prevented. Further, when the urging force on the advance side is greater than the average torque at the time of start of the engine, even if the engine abnormally stops and the hydraulic control is disconnected halfway so that the camshaft can not stop at the most advance position with respect to the crankshaft, when the driven-side rotor is displaced to the advance side, the driven-side rotor is locked by the locking mechanism and held at the most advance position by the drive torque received by the camshaft 1, the engine can be started normally. Even if the driven-side rotor is not locked worst, it moves to the most advance position while being flapped by the drive torque received by the camshaft 1. Therefore, the engine starts normally.

Also in the fifth embodiment, it is possible to prevent the opening period of the exhaust valve from overlapping with the opening period of the intake valve at the time of start of the engine. Therefore, the internal EGR amount can be reduced. Accordingly, the startability of the engine is enhanced, and the unburned fuel is not discharged into the exhaust gas, thus enhancing the purifying effect of the exhaust gas.

(Sixth Embodiment)

Figure 9A:
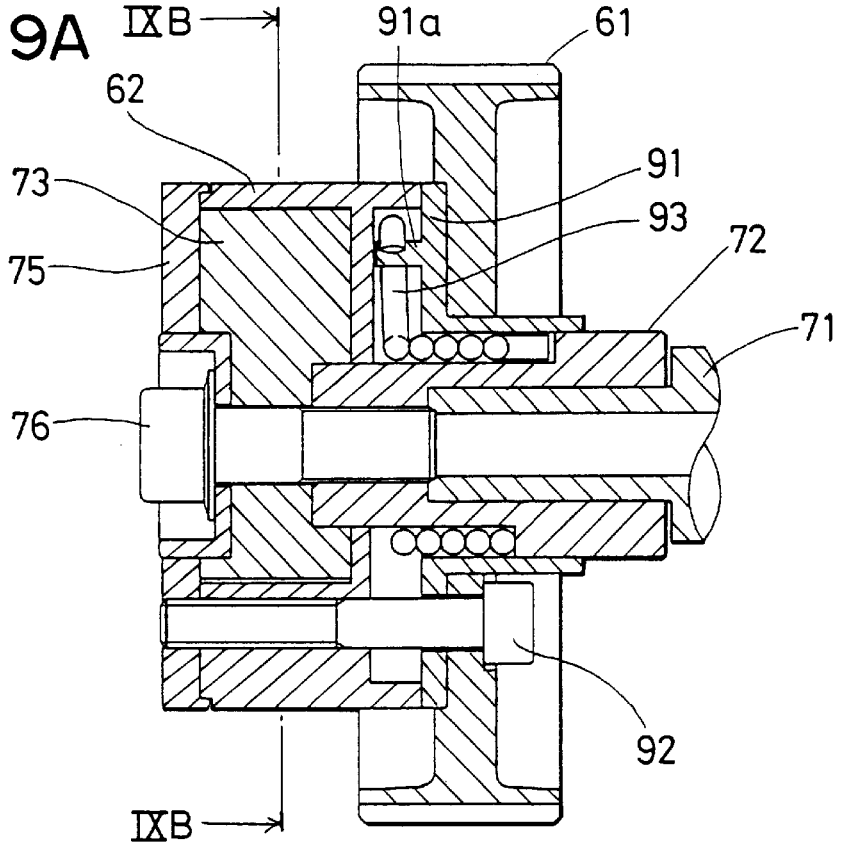
FIG. 9A is a longitudinal sectional view showing a valve timing regulation apparatus according to the sixth embodiment.
Figure 9B:
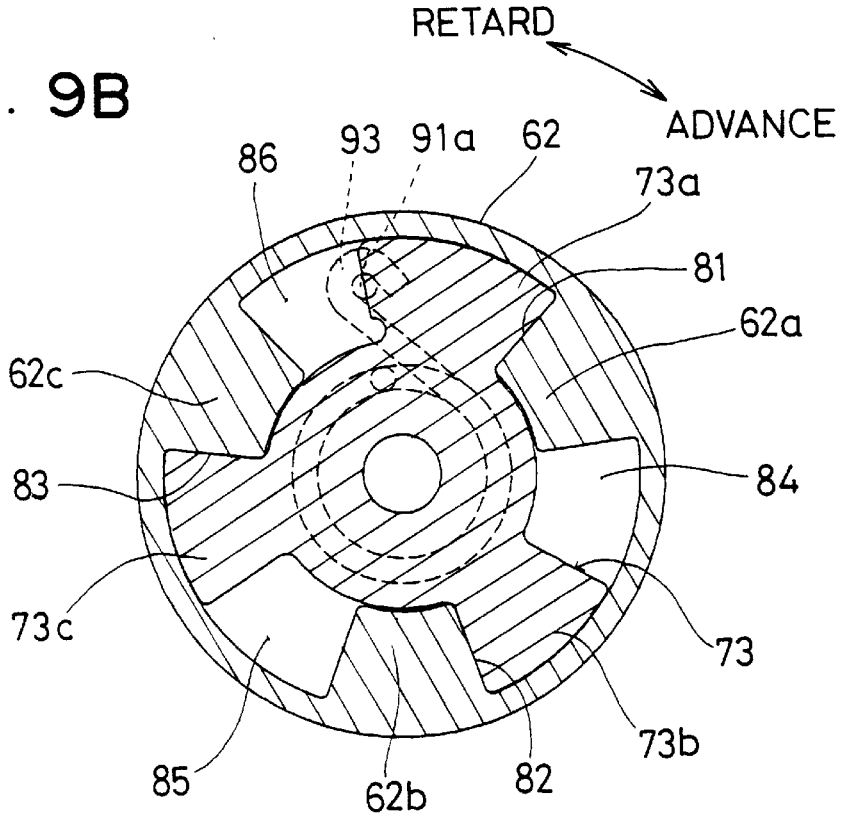
FIG. 9B is a sectional view taken on line IXB—IXB in FIG. 9A.

In FIGS. 9A and 9B showing the sixth embodiment of the present invention, substantially the same constituent parts as those of the fifth embodiment are indicated by the same reference numerals. Particularly, in FIG. 9B, there is shown the state where the vane rotor 73 is at the most advance position with respect to the shoe housing 62.

The timing pulley 61, a rear plate 91, the shoe housing 62 and the front plate 75 are coaxially secured by means of a bolt 92 to constitute a drive-side rotor. Since the inner peripheral wall of the rear plate 91 is rotatably supported on the outer peripheral wall of the camshaft sleeve 72, the camshaft 71 can be rotated relatively to the timing pulley 61.

A torsional spring 93 as the first urging means is disposed in the outer periphery of the camshaft sleeve 72, one end of which is secured to a stop portion 91*a* of the rear plate 91 while the other end is secured to the camshaft sleeve 72. The torsional spring 93 urges the vane rotor 73 toward the advance shown in FIG. 10 with respect to the shoe housing 62. It is designed so that the urging force of the torsional spring 93 is greater than the maximum torque at the time of start of the engine.

Although the locking mechanism is not shown, one having the configuration similar to that of the fifth embodiment is provided. With the construction of the sixth embodiment, it is possible to prevent the opening period of the exhaust valve from overlapping with the opening period of the intake valve at the time of start of the engine. Therefore, the internal EGR amount can be reduced. Accordingly, the startability of the engine is enhanced, and the unburned fuel is not discharged into the exhaust gas, thus enhancing the purifying effect of the exhaust gas.

(Seventh Embodiment)

Figure 10:
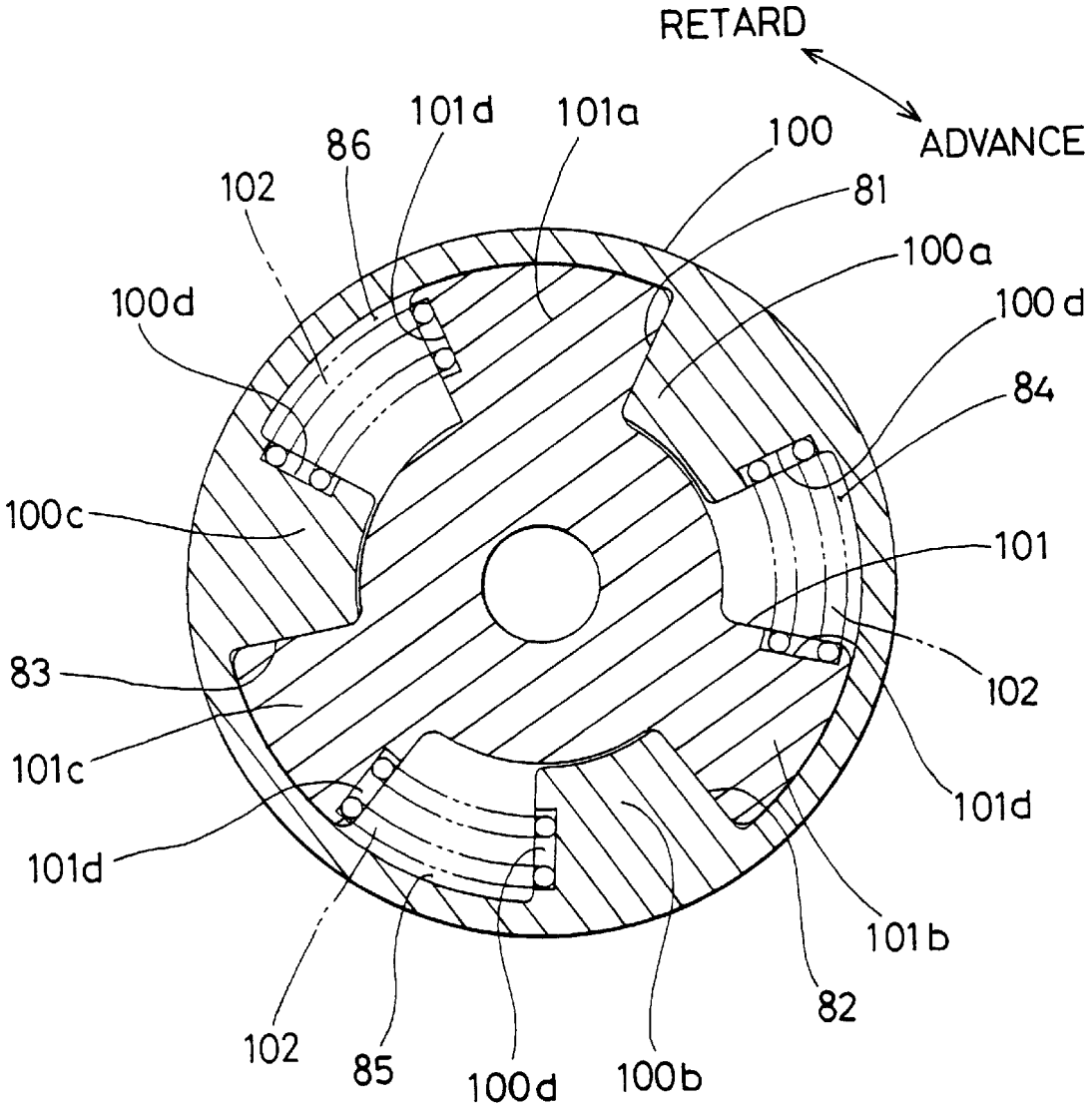
FIG. 10 is a cross-sectional view showing a valve timing regulation apparatus according to the seventh embodiment.

In FIG. 10 showing the seventh embodiment of the present invention, a spring 101 as the first urging means for urging a vane rotor 101 toward the advance side with respect to a housing 100 is received in the advance hydraulic chambers 84, 85 and 86. It is designed that the urging force of the spring 101 is greater than the maximum torque at the time of start of the engine.

Recesses 100*d* are formed in the peripheral end on the advance side of shoes 100*a*, 100*b* and 100*c*, recesses 101*d* are formed in the peripheral end on the retard side of vanes 101*a*, 101*b* and 101*c*, and springs 102 have ends stopped at recesses 100*d* and 101*d*.

With the construction of the seventh embodiment, it is possible to prevent the opening period of the exhaust valve from overlapping with the opening period of the intake valve at the time of start of the engine, similar to the fifth embodiment. Therefore, the internal EGR amount can be reduced. Accordingly, the startability of the engine is enhanced, and the unburned fuel is not discharged into the exhaust gas, thus enhancing the purifying effect of the exhaust gas.

(Eighth Embodiment)

In the above embodiments of the present invention explained above, the drive-side rotor and the driven-side rotor are coupled at the most advance position by the locking mechanism, and the opening periods of the exhaust valve and the intake valve are not overlapped. However, if the period is in the range in which the engine can start normally and shift to the operating condition, the opening periods of the exhaust valve and the intake valve may be overlapped, and the coupling position between the drive-side rotor and the driven-side rotor by the locking mechanism may be on the retard side rather than the most advance position.

(Ninth Embodiment)

While a description has been made of the embodiments all of which are provided with the locking mechanism, it is to be noted that the configuration without provision of the locking mechanism may be employed. Particularly, when the urging force for urging the driven-side rotor toward the advance is set to be greater than the maximum torque at the time of start of the engine, even in the configuration without provision of the locking mechanism, it is possible to prevent the flapping of the driven-side rotor.

(Tenth Embodiment)

While in the above embodiments, it is designed so that the sum of the urging forces for urging the camshaft toward the advance is greater than the maximum torque at the time of start of the engine, it is to be noted that the design can be made so that the sum of the urging forces is greater than the average torque at the time of start of the engine. With this, even in the state where at the time of start of the engine, the driven-side rotor is not at the most advance position with respect to the drive-side rotor, the driven-side rotor can move to the most advance position while being flapped by the drive torque received by the camshaft to start the engine normally and shift to the normal operating condition.

(Eleventh Embodiment)

Figure 11:
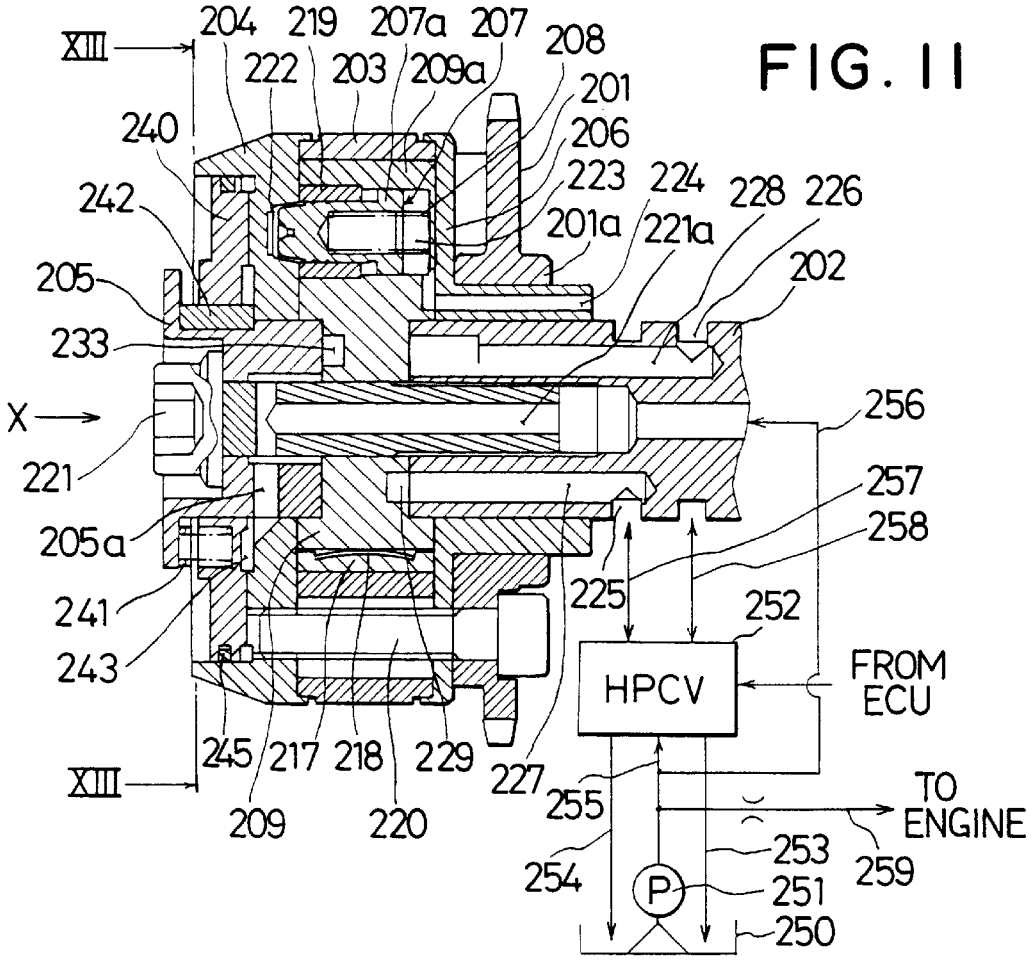
FIG. 11 is a longitudinal sectional view showing a valve timing regulation apparatus according to the eleventh embodiment.

In FIG. 11 showing the eleventh embodiment, a chain sprocket 201 is transmitted with the drive force from a crankshaft (not shown) as a drive shaft of an engine so that the chain sprocket 201 rotates in synchronism with a crankshaft. The drive force is transmitted from the chain sprocket 201 to a camshaft 202 as a driven shaft to open and close an exhaust valve not shown. The camshaft 202 is rotatable in a predetermined phase difference with respect to the chain sprocket 201. The chain sprocket 201 and the camshaft 202 rotate clockwise as viewed in the direction X indicated by arrow in FIG. 11. Hereinafter, the rotation direction will be referred to as the advance direction.

Figure 12:
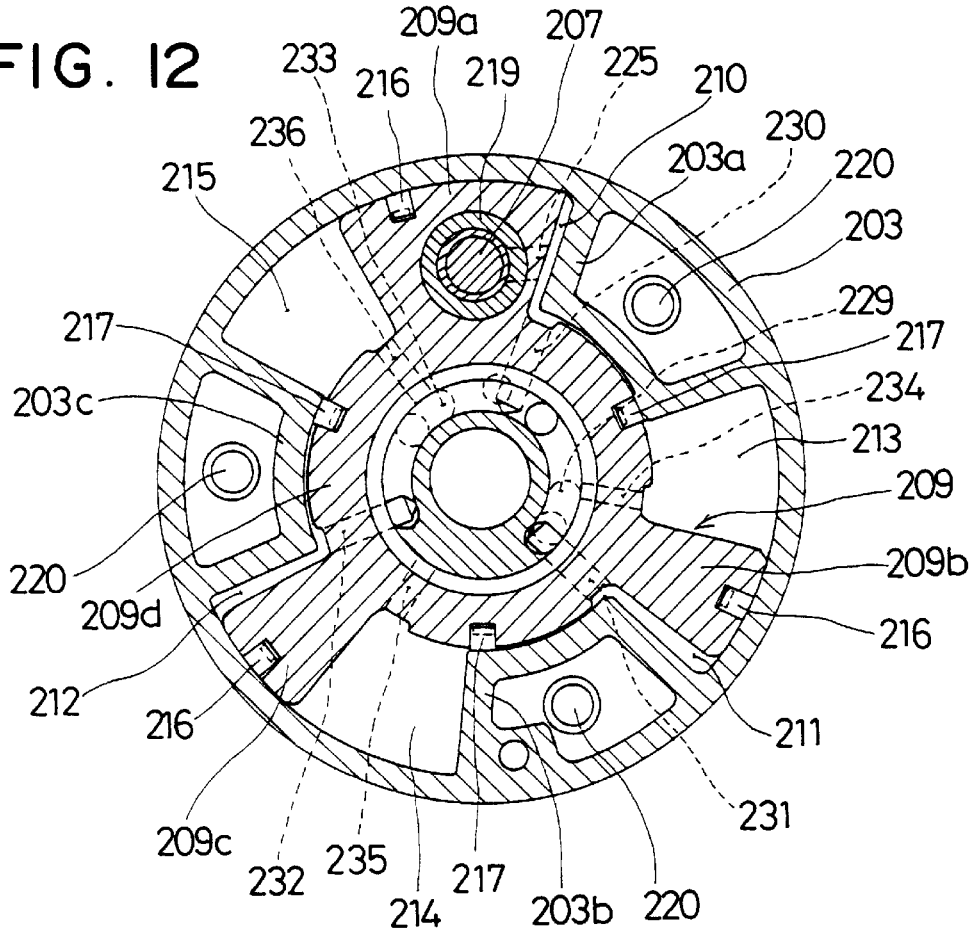
FIG. 12 is a cross sectional view taken in a direction X in FIG. 11.

As shown in FIGS. 11 and 12, the chain sprocket 201, a shoe housing 203, a front plate 204 and a rear plate 206 are coaxially secured by means of a bolt 220 to constitute a drive-side rotor and constitute a part of drive force transmission means.

As shown in FIG. 12, the shoe housing 203 has trapezoidal shoes 203*a*, 203*b*, and 203*c* substantially at equiangular intervals in the peripheral direction. The inner peripheral surfaces of the shoes 203*a*, 203*b*, and 203*c* are formed to be circular in section, and semicircular space portions as receiving chambers for vanes 209*a*, 209*b* and 209*c* are formed in three gaps in the peripheral direction of the shoes 203*a*, 203*b* and 203*c*.

As shown in FIGS. 11 and 12, a vane rotor 209 has vanes 209*a*, 209*b* and 209*c* substantially at equiangular intervals in the peripheral direction, and the vanes 209*a*, 209*b* and 209*c* are rotatably received in the semicircular space portions formed in the peripheral gaps of the shoes 203*a*, 203*b* and 203*c*. The vane rotor 209 and a bushing 205 are secured integrally with the camshaft 202 by means of a bolt 221 to constitute a driven-side rotor and constitute a part of the drive force transmission means. The bushing 205 secured integrally with the vane rotor 209 is fitted in the inner peripheral wall of the front plate 204 relatively rotatably. As shown in FIG. 12, a fine clearance is provided between the outer peripheral wall of the vane rotor 209 and the inner peripheral wall of the shoe housing 203, and the vane rotor 209 is rotatable relative to the shoe housing 203. Seal members 216, 217 biased by a spring 218 are fitted in the outer peripheral walls of the vanes 209*a*, 209*b* and 209*c* and in the outer peripheral wall of a boss portion 209*d* of the vane rotor 209 to prevent the operating fluid from leaking between the fluid chambers.

A retard hydraulic fluid chamber 210 is formed between the shoe 203*a* and the vane 209*a*, a retard hydraulic fluid chamber 211 is formed between the shoe 203*b* and the vane 209*b*, and an advance hydraulic fluid chamber 212 is formed between the shoe 203*c* and the vane 209*c*. Further, an advance hydraulic fluid chamber 213 is formed between the shoe 203*a* and the vane 209*b*, an advance hydraulic fluid chamber 214 is formed between the shoe 203*b* and the vane 209*c*, and an advance hydraulic fluid chamber 215 is formed between the shoe 203*c* and the vane 209*a*.

With the above-described configuration, the camshaft 202 and the vane rotor 209 are coaxially rotatable relative to the chain sprocket 201, the shoe housing 203, the front plate 204 and the rear plate 206.

As shown in FIG. 11, in a stopper piston 207 as a stopper, a flange portion 207*a* is slidably supported on the inner wall of the vane 209*a* of the vane rotor 209, and can be fitted in a stopper hole 222 formed in the front plate 204 by the urging force of a spring 208. A communication path 224 formed in the rear plate 206 is communicated with a receiving hole 223 on the right side of the flange portion 207*a* and opened to atmosphere, thus not impeding the movement of the stopper piston 207. A guide ring 219 is pressed and held in the inner wall of the vane 209*a* forming the receiving hole 223, and the stopper piston 207 is inserted into a guide ring 219. Accordingly, the stopper piston 207 is received in the vane 209*a* axially slidably of the camshaft 202 and urged against the front plate 204 by means of the spring 208. The receiving hole 223 on the left side of the flange portion 207*a* is communicated with the retard fluid chamber 210 through a fluid path 225 as shown in FIG. 12. When operating fluid is supplied to the retard fluid chamber 210, the stopper piston 207 comes out of the stopper hole 222 against the urging force of the spring 208.

The position of the stopper piston 207 and the stopper hole 222 are set so that the stopper piston 207 is fitted in the stopper hole 222 when the camshaft 202 is at the most advance position with respect to the crankshaft, that is, when the vane rotor 209 is at the most advance position with respect to the front plate 204. The stopper piston 207 and the stopper hole 222 constitutes the locking mechanism.

Figure 13:
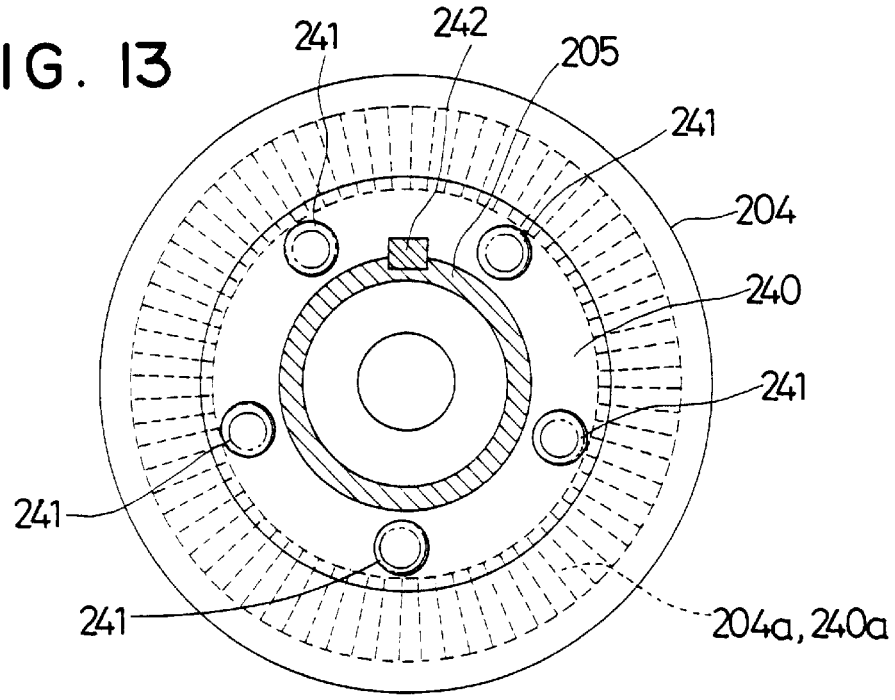
FIG. 13 is a sectional view taken on line XIII—XIII in FIG. 11.
Figure 14:
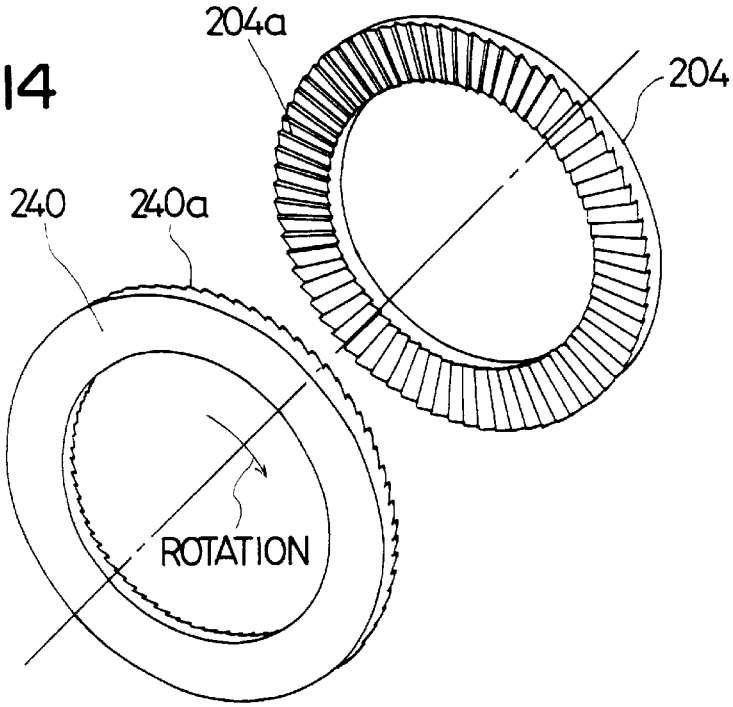
FIG. 14 is a perspective view showing a one-way clutch in the eleventh embodiment.

A clutch piston 240 is secured by a key 242 so that the former cannot be rotated with respect to the bushing 205 but can be moved in the axial direction. An annular seal member 245 is fitted in the outer peripheral edge portion of the clutch piston 240 to prevent a leakage of operating fluid in a release fluid chamber 243. As shown in FIGS. 13 and 14, Gear teeth 204*a* and gear teeth 240*a* are formed in opposed surfaces of the front plate 204 and the clutch piston 240. A one-way clutch is constituted in the state where the front plate 204 and the clutch piston 240 are coupled.

Figure 15A:
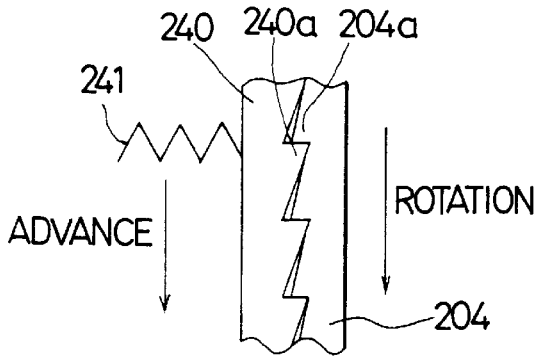
FIGS. 15A is a schematic view of a one-way clutch showing the state of coupling and FIG. 15B is a schematic view of the same showing the state of release.

In the state where the operating fluid is not supplied to the release fluid chamber 243, the clutch piston 240 is coupled to the front plate 204 by the urging force of the spring 241. In the state where the front plate 204 is coupled to the clutch piston 240 and the gear teeth 204*a* and the gear teeth 240 engage with each other, as shown in FIG. 15A, the front plate 204 transmits the drive force to the clutch piston 240 only in the advance direction. That is, when the clutch piston 240 rotates toward the retard direction with respect to the front plate 204, the gear teeth 240*a* is stopped by the gear teeth 204*a* so that the retard movement of the clutch piston 240 with respect to the front plate 204 is controlled. That is, the retard movement of the camshaft 202 with respect to the crankshaft is controlled. On the other hand, the clutch piston 240 rotates toward the advance side with respect to the front plate 204, the gear teeth 240*a* and the gear teeth 204*a* slip each other so that the clutch piston 240 is rotatable toward the advance side with respect to the front plate 204. That is, the camshaft 202 is rotatable toward the advance side with respect to the crankshaft.

In a boss portion 209*d* of the vane rotor 209, a fluid path 229 is provided at a portion in contact with the camshaft 202, and a fluid path 233 at a portion in contact with the bushing 205, as shown in FIGS. 11 and 12. The fluid paths 229 and 233 are formed to be circular. The fluid path 229 is communicated with retard fluid chambers 210, 211 and 212 by fluid paths 230, 231 and 232 and is communicated with a receiving hole 223 on the left side of the flange portion 207*a* by a fluid path 225. The fluid path 229 is communicated with a fluid path 257 through the fluid path 227 and the annular fluid path 225.

The fluid path 233 is communicated with the advance fluid chambers 213, 214 and 215 by fluid paths 234, 235 and 236. The fluid path 233 is communicated with a fluid path 258 through an annular fluid path 226.

A hydraulic fluid pressure control valve (HPCV) 252 comprises a solenoid control type spool valve which switches and controls a fluid path by a control signal delivered from ECU according to the operating condition of the engine. A supply fluid passage 255 for feeding under pressure fluid in a fluid tank 250 from a pump 251, and a discharge fluid passage 253 or 254 for discharging fluid into the fluid tank 250 are selectively communicated with or cut off from fluid paths 257 and 258 by switching the fluid control valve 252. A clutch fluid path 256 is communicated with the supply fluid passage 255 and communicated with the release fluid chamber 243 through a fluid path 221*a* and fluid path 205*a*. The supply fluid passage 255 is communicated with a supply fluid passage 259 for supplying operating fluid to various parts of the engine through a throttle. It is noted that the configuration may be dispensed with the throttle.

The operation of the eleventh embodiment operates as follows.

1. When the engine normally stops (1-1) When the engine normally stops, the retard fluid chambers 210, 211, 212 are released to the drain side, and the fluid control valve 252 is switched so that the operating fluid pressure is applied to the advance fluid chambers 213, 214, 215. Then, the vane rotor 209 is moved to the most advance position with respect to the shoe housing 203, and the stopper piston 207 as the locking mechanism is fitted in the stopper hole 222 so that the front plate 204 and the vane rotor 209 are coupled. Then, the camshaft 202 is held at the most advance position with respect to the crankshaft and the engine stops.

After the stop of the engine, that is, after the stop of the pump 251, the fluid pressure of the retard fluid chambers is lowered by the fluid control valve 252, and the pressure of the advance fluid chambers is reduced by the leakage of fluid between the vane rotor 209 and the shoe housing 203 whereby the pressure of the supply fluid passage 255 in communication with the advance fluid chambers corresponds to atmospheric pressure. Accordingly, the fluid pressure of the release fluid chamber 243 in communication with the supply fluid passage 255 through the clutch passage 256, the fluid path 221*a* and the fluid path 205*a* is also atmospheric pressure so that the clutch piston 240 is coupled to the front plate 204 by the urging force of the spring 241.

(1-2) Even if the engine is started, the stopper piston 207 remains fitted in the stopper hole 222 till the operating fluid at a predetermined pressure is supplied to the fluid paths and the fluid chambers, and the camshaft 202 is held at the most advance position with respect to the crankshaft. In the Eleventh embodiment, it is designed so that in the most advance state shown in FIG. 11, the opening periods of the exhaust valve and the intake valve are not overlapped. Accordingly, it is possible to prevent the reversed flow of the exhaust gas into the combustion engine to reduce the internal EGR amount, whereby the engine starts normally.

The release fluid pressure of the front plate 204 and the clutch piston 240 is set to the pressure necessary to advance the vane rotor 209 and to be lower than the release pressure of the stopper piston 207, so that the clutch piston 240 remains coupled to the front plate 240 by the urging force of the spring 241 till the operating fluid at the set pressure is supplied to the release fluid chamber 243. In the state where the stopper piston 207 is fitted in the stopper hole 222, the camshaft 202 is at the most advance angle with respect to the crankshaft irrespective of the coupling or release between the front plate 204 and the clutch piston 240.

When the engine shifts to the normal operation and the operating fluid larger in fluid pressure than a predetermined pressure is introduced into the fluid paths and the fluid chambers, the stopper piston 207 comes out of the stopper hole 222 to release the coupling between the front plate 204 and the vane rotor 209 by the locking mechanism. Since the fluid pressure in the release fluid chamber 243 rises, the clutch piston 240 is moved leftward in FIG. 11 against the urging force of the spring 241, and the coupling between the front plate 204 and the clutch piston 240 is released. Accordingly, the vane rotor 209 is rotated relative to the shoe housing 203 by the operating fluid pressure applied to the retard fluid chambers 210, 211, 212 and the advance fluid chambers 213, 214, 215 to regulate the relative phase difference of the camshaft 201 with respect to the crankshaft.

2. When the engine abnormally stops

When the engine abnormally stops, the fluid control is disconnected halfway. Therefore, the vane rotor 209 is not stopped at the most advance position with respect to the shoe housing 203, and the stopper pin 207 is not sometimes fitted in the stopper hole 222. However, the pressure of the retard fluid chambers is controlled to be released to the drain by the fluid control valve 252, and as a result, the pressure of the advance fluid chambers is lowered by the leakage of fluid between the vane rotor 209 and the shoe housing 203 as previously mentioned. Thus, the pressure of the supply fluid passage 255 in communication with the advance fluid chamber corresponds to the atmospheric pressure so that the front plate 204 is coupled to the clutch piston 240.

When the engine restarts in this state, in the case where the fluid pressure of the release fluid chamber is low, the pump 251 operates normally, and the operating fluid is supplied to the release fluid chamber 243 through the clutch fluid path 256, the fluid path 221*a* and the fluid path 205*a*. The clutch piston 240 is coupled to the front plate 204 by the urging force of the spring 241 while the pressure is lower than the setting of the release fluid pressure.

Figure 15B:
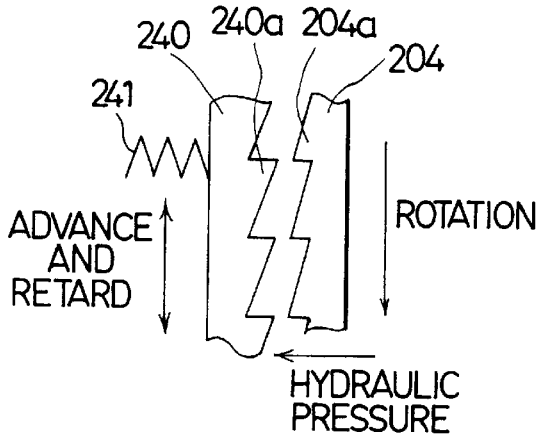
Figure 16A:
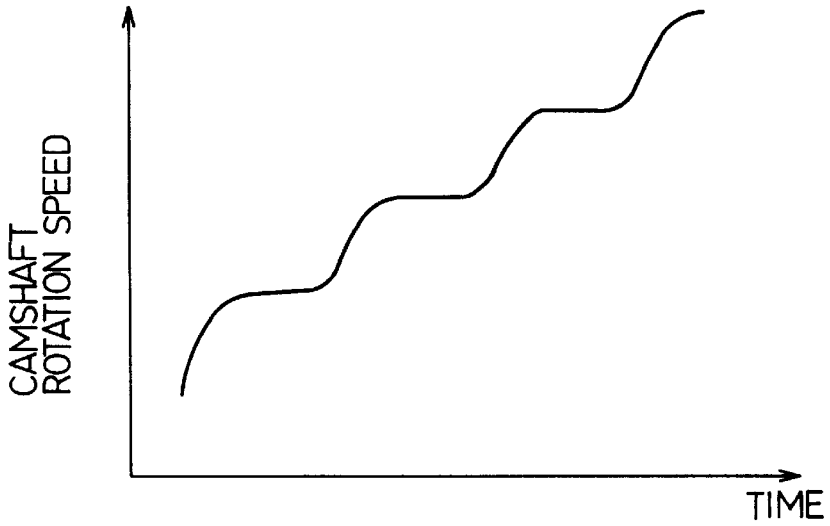
FIG. 16A is a time chart showing the state of coupling the one-way clutch.
Figure 16B:
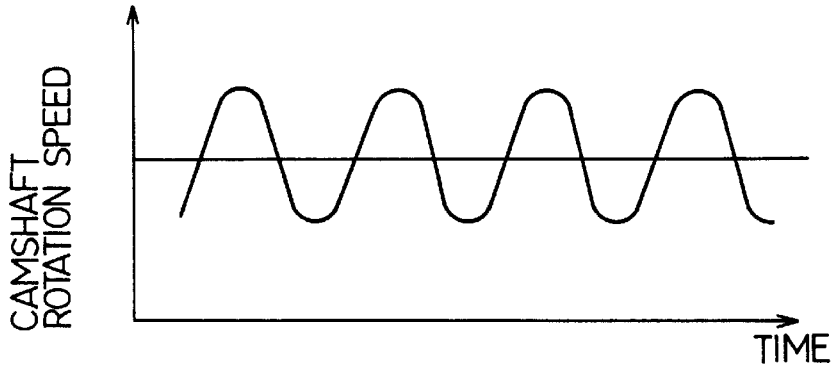
FIG. 16B is a time chart showing the state of releasing the one-way clutch.

As shown in FIG. 15B, in the case where the coupling between the front plate 204 and the clutch piston 240 is released, the rotational speed of the camshaft 202 is changed as shown in FIG. 16B by the drive torque received when the exhaust valve is opened and closed. A description will be made of the case where in the state in which the front plate 204 and the clutch piston 240 are coupled as shown in FIG. 15A, the camshaft 202 receives the drive torque for producing the variation in the rotational speed as shown in FIG. 16B.

(1) When the camshaft 202 receives the drive torque in the direction of reducing the rotational speed toward the advance side, that is, toward the retard side, the gear teeth 240*a* is stopped at the gear teeth 204*a* on the retard side, so that the rotational speed of the camshaft 202 is held without being lowered.

(2) When the camshaft 202 receives the drive torque in the direction of increasing the rotational speed toward the advance side, that is, toward the advance side, the gear teeth 240*a* slips toward the advance side with respect to the gear teeth 204*a* on the advance side, so that the rotational speed of the camshaft 202 increases.

The camshaft 202 repeats the movement of ① and ② by the torque received by the camshaft 202 whereby the rotational speed of the camshaft 202 increases as shown in FIG. 16A. When the camshaft 202 quickly moves to the most advance position with respect to the crankshaft, the stopper piston 207 fits in the stopper hole 222. Accordingly, the internal EGR amount can be reduced and the engine starts normally, similar to the normal stop of the engine.

3. In the case where the fluid pressure of the operating fluid lowers to a level less than a predetermined pressure due to the low rotation of the engine or the trouble of the pump 252, the fluid pressure of the release fluid chamber 243 also lowers so that the front plate 204 and the clutch plate 240 are coupled. Then, the camshaft 202 is rotated to the most advance position by the drive torque received by the camshaft 202 as mentioned above, thus continuing the operating condition of the engine without increasing the internal EGR amount.

In the eleventh embodiment explained above, in the case where the engine stops normally, the fluid control valve is switched to move the camshaft 202 to the most advance position with respect to the crankshaft so that the stopper piston 207 is fitted in the stopper hole 222 to thereby hold the camshaft 202 at the most advance position with respect to the crankshaft. Accordingly, the overlapping of the opening valve of the exhaust valve with the opening period of the intake valve at the time of start of the engine is prevented and the internal EGR amount is reduced. Therefore, the startability of the engine is enhanced, and the discharge amount of the noxious components into the exhaust gas can be reduced.

Also in the case where the engine abnormally stops so that the fluid control is discontinued halfway and the camshaft 202 cannot be stopped at the most advance position with respect to the crankshaft and the stopper piston 207 cannot be fitted in the stopper hole 222, the front plate 204 and the clutch plate 240 which constitute one-way clutch are coupled so that the camshaft 202 quickly rotates to the most advance position with respect to the crankshaft, thus enhancing the start responsiveness of the engine and causing the engine to start normally.

Further, even if the operating fluid pressure is lowered due to the low rotation of the engine and the trouble of the pump, the one-way clutch is coupled as the operating fluid pressure lowers. Therefore, the camshaft 202 quickly rotates to the most advance position with respect to the crankshaft, and the operating condition of the engine can be continued.

(Twelfth Embodiment)

Figure 17:
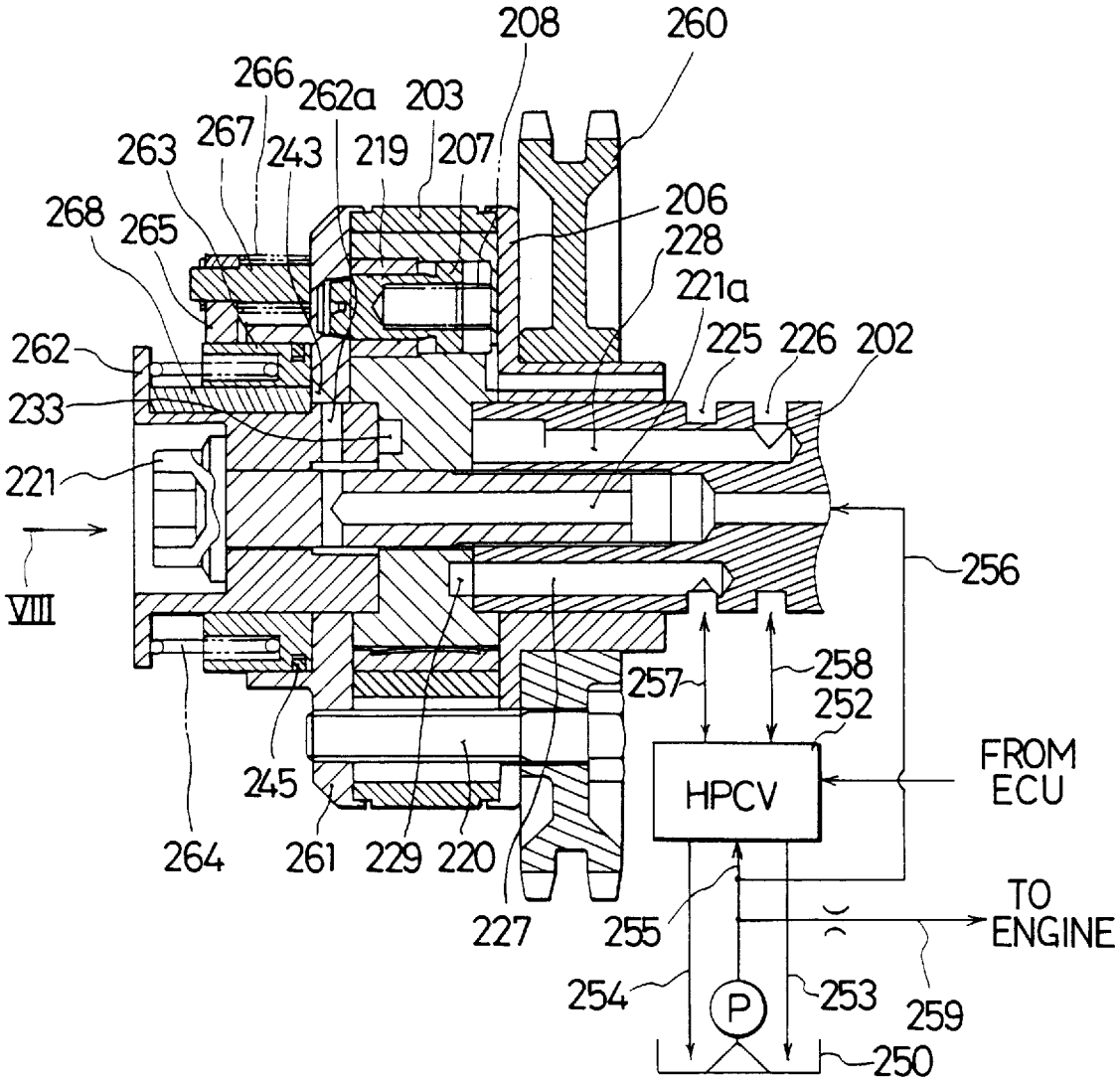
FIG. 17 is a longitudinal sectional view showing a valve timing regulation apparatus according to the twelfth embodiment.
Figure 18:
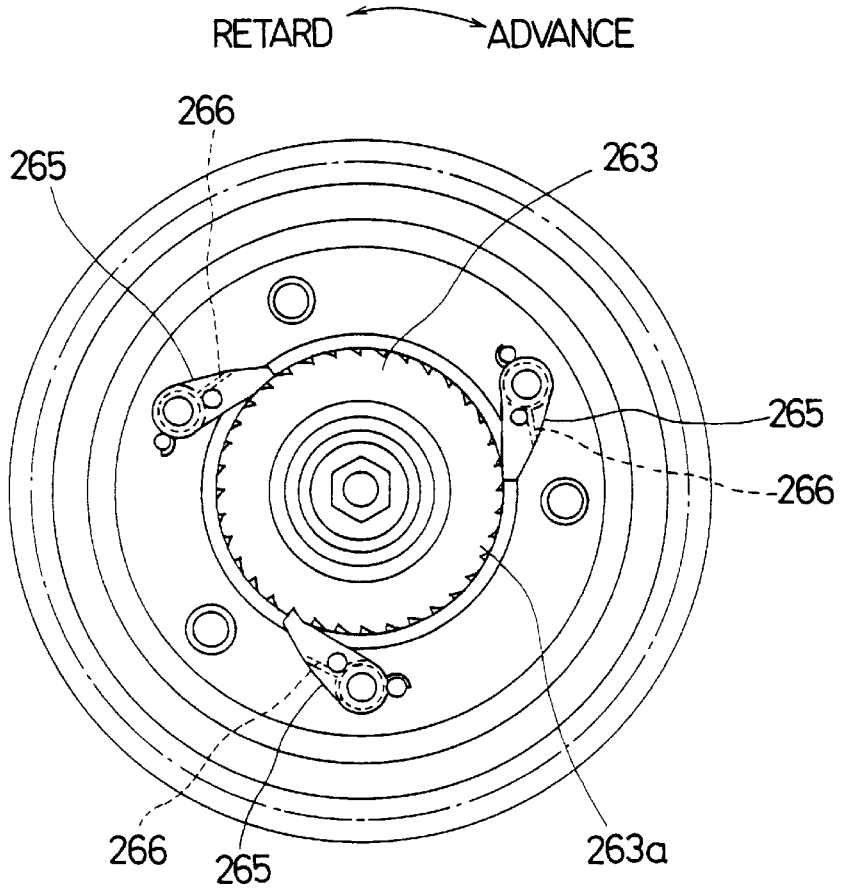
FIG. 18 is a view taken in a direction XVIII in FIG. 17.
Figure 19:
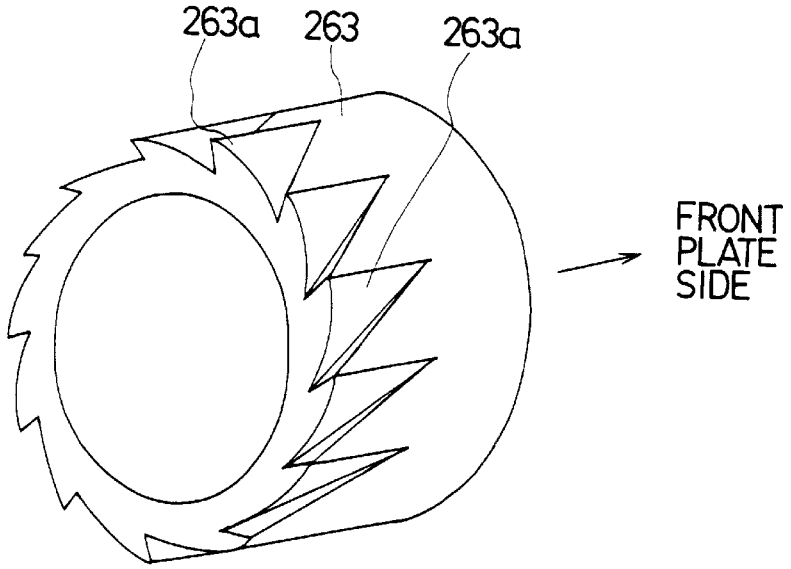
FIG. 19 is a schematic perspective view showing a gear of one-way clutch in the twelfth embodiment.

In FIGS. 17, 18 and 19 showing the twelfth embodiment, a chain sprocket 260 is a sprocket connected to a parallel-running or dual chain. A front plate 261 is not provided with the gear teeth unlike the front plate 204 in Eleventh embodiment, and is secured to the chain sprocket 260, the shoe housing 203 and the rear plate 206 by means of bolt 202.

A bushing 262 is secured to the camshaft 202 together with the vane rotor 209 by means of a bolt 221. The gear 263 is secured by means of a key 268 so that the former is not rotatable with respect to the bushing 262 but can be moved in the axial direction. A spring 264 urges the gear 63 toward the front plate 261. As shown in FIG. 19, the gear 263 is formed to be cylindrical and is formed with gear teeth 263*a* in the outer peripheral wall by a predetermined length from the counter front plate in the axial direction. When the fluid pressure of the operating fluid introduced into the release fluid chamber 243 through the fluid path 262*a* shown in FIG. 17 exceeds the pressure necessary for advancing the vane 209, the gear 263 moves leftward in FIG. 17 against the urging force of the spring 264.

As shown in FIGS. 17 and 18, a pawl 265 is rotatably mounted on a support shaft 267 secured to the front plate 261, and urged toward the diametrical internal gear 263 by means of a helical spring 266. In the state where operating fluid is not introduced into the release fluid chamber 243, the pawl 265 engages the gear teeth 263*a* of the gear 263. When the operating fluid is introduced into the release fluid chamber 243 so that the gear 263 moves leftward in FIG. 17, the pawl 5 cannot be engaged with the gear teeth 263*a*. When the camshaft 202 is attempted to relatively move toward the retard shown in FIG. 18 by the drive torque received by the camshaft 202 when the exhaust valve is opened and closed, the gear teeth 263*a* of the gear 263 is stopped by the pawl 265 so that its movement toward the retard is controlled. The pawl 265 does not control the movement of the camshaft 202 toward the advance. As described, the gear 263, the pawl 265 and the spring 266 constitute a one-way clutch which controls the movement of the camshaft 202 toward the retard and does not control the movement thereof toward the advance.

In the twelfth embodiment described above, even in the case where the camshaft 202 cannot stop at the most advance position with respect to the crankshaft and the stopper piston 207 cannot be fitted in the stopper hole 222, the gear 263 and the pawl 265 constituting the one-way clutch engage with each other whereby the camshaft 202 quickly rotates to the most advance position with respect to the crankshaft. Accordingly, the overlapping of the opening valve of the exhaust valve with the opening period of the intake valve at the time of start of the engine is prevented and the internal EGR amount is reduced. Therefore, the startability of the engine is enhanced, and the discharge amount of the injurious components into the exhaust gas can be reduced.

Further, even if the operating fluid pressure should be lowered due to the low rotation of the engine and the trouble of the pump, the one-way clutch is coupled whereby the crankshaft 202 can be rotated to the most advance position with respect to the crankshaft, thus enabling the continuation of the operating condition of the engine.

(Thirteenth Embodiment)

Figure 20:
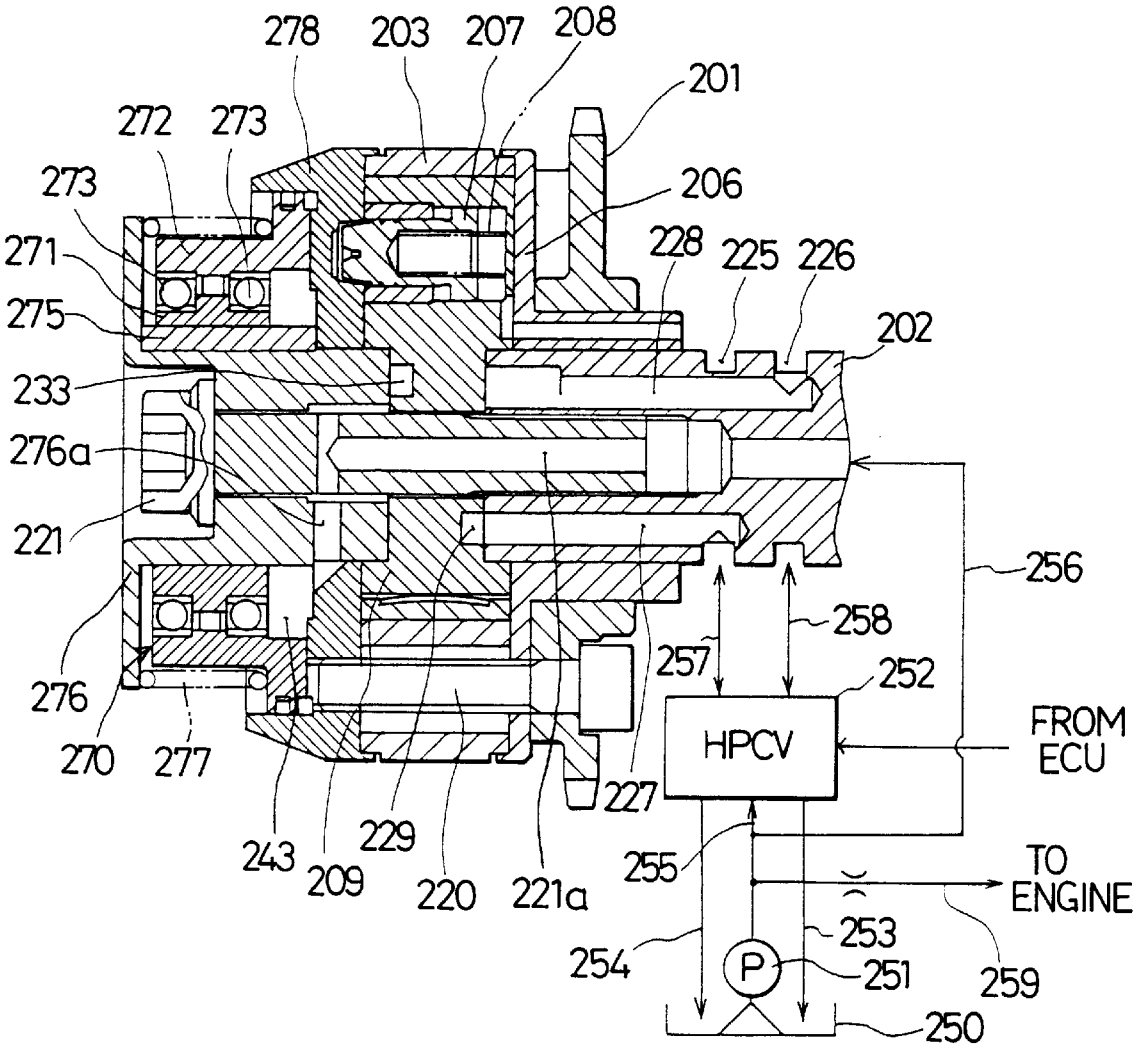
FIG. 20 is a longitudinal sectional view showing a valve timing regulation apparatus according to the thirteenth embodiment.

In FIG. 20 showing the thirteenth embodiment, a one-way clutch 270 is a friction type. An inner ring 271 is supported on an outer ring 272 of the one-way clutch 270 by means of a bearing 273 so that the movement of the camshaft 202 toward the retard is controlled but the movement thereof toward the advance is not controlled. A bushing 276 is secured to the camshaft 202 together with the vane rotor 209 by means of a bolt 221. The inner ring 271 is secured by a key 275 so that the former is not rotatable with respect to the bushing 276 but can be moved in the axial direction.

The one-way clutch 270 is urged toward the front plate 278 by means of a spring 277. The outer ring 272 is pressed against the front plate 278 by the urging force of the spring 277 whereby a frictional force acts on a contact portion between the outer ring 272 and the front plate 278. Both the front plate 278 and the outer ring 272 are rotated together by the frictional force.

(1) In the state shown in FIG. 20 where the operating fluid at a predetermined pressure is not introduced into the release fluid chamber 243, the outer ring 272 is pressed against the front plate 278 by the urging force of the spring 277, and both the front plate 278 and the outer ring 272 are rotated by the frictional force.

When the camshaft 202 rotates relative to the retard, the movement of the inner ring 271 toward the retard is stopped by the outer ring 272. On the other hand, even if the camshaft 202 moves relative to the advance, the movement of the inner ring 271 toward the advance is not controlled by the outer ring 272.

(2) When the operating fluid is introduced into the release fluid chamber 243 and the one-way clutch 270 moves leftward in FIG. 20, the front plate 278 is separated from the outer ring 272. At this time, the stopper piston 207 also comes out of the stopper hole 222, and the relative phase control between the crankshaft and the camshaft 202 can be made by the fluid control to the advance fluid chambers and the retard fluid chambers.

In the thirteenth embodiment explained above, even in the case where the camshaft 101 cannot be stopped at the most advance position with respect to the crankshaft so that the stopper piston 207 cannot be fitted in the stopper hole 222, the one-way clutch 270 is pressed against the front plate 278 whereby the camshaft 202 quickly rotates to the most advance position with respect to the crankshaft. Accordingly, the overlapping of the opening valve of the exhaust valve with the opening period of the intake valve at the time of start of the engine is prevented and the internal EGR amount is reduced. Therefore, the startability of the engine is enhanced, and the discharge amount of the injurious components into the exhaust gas can be reduced.

Further, even if the operating fluid pressure should be lowered due to the low rotation of the engine and the trouble of the pump, the one-way clutch is coupled whereby the camshaft 202 can be rotated to the most advance position with respect to the crankshaft, thus enabling the continuation of the operating condition of the engine.

(Fourteenth Embodiment)

Figure 21:
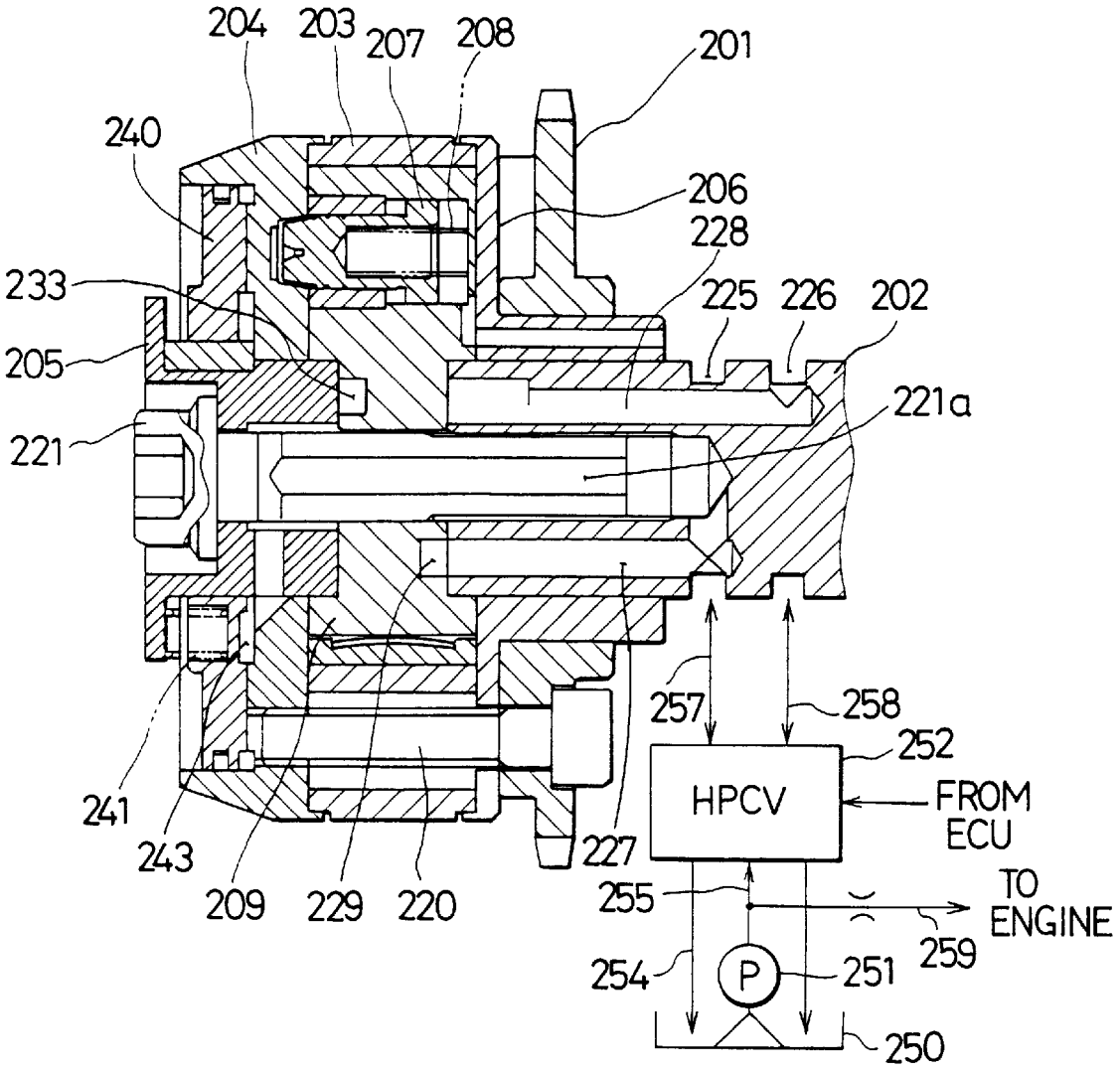
FIG. 21 is a longitudinal sectional view showing a valve timing regulation apparatus according to the fourteenth embodiment.

In FIG. 21 showing the fourteenth embodiment, a fluid path 221*a* is communicated with a fluid path 227 in communication with the retard fluid chambers to thereby apply the same fluid pressure as that of the retard fluid chambers to the release fluid chamber 243.

The front plate 204 and the clutch plate 240 are coupled when the fluid pressure applied to the retard fluid chambers lowers, that is, the camshaft 202 rotates toward the advance side with respect to the crankshaft so that the camshaft 202 is quickly rotated to the advance side. On the other hand, the front plate 204 and the clutch plate 240 are released from coupled condition when the fluid pressure applied to the retard fluid chambers rises, that is, the camshaft 202 is rotated toward the retard side with respect to the crankshaft to render the rotation of the camshaft 202 toward the retard side possible.

In the fourteenth embodiment, even in the case where the camshaft 101 cannot be stopped at the most advance position with respect to the crankshaft so that the stopper piston 207 cannot be fitted in the stopper hole 222, the clutch piston 240 is coupled to the front plate 204 whereby the camshaft 202 quickly rotates to the most advance position with respect to the crankshaft. Thus, the engine starts normally.

(Fifteenth Embodiment)

Figure 22:
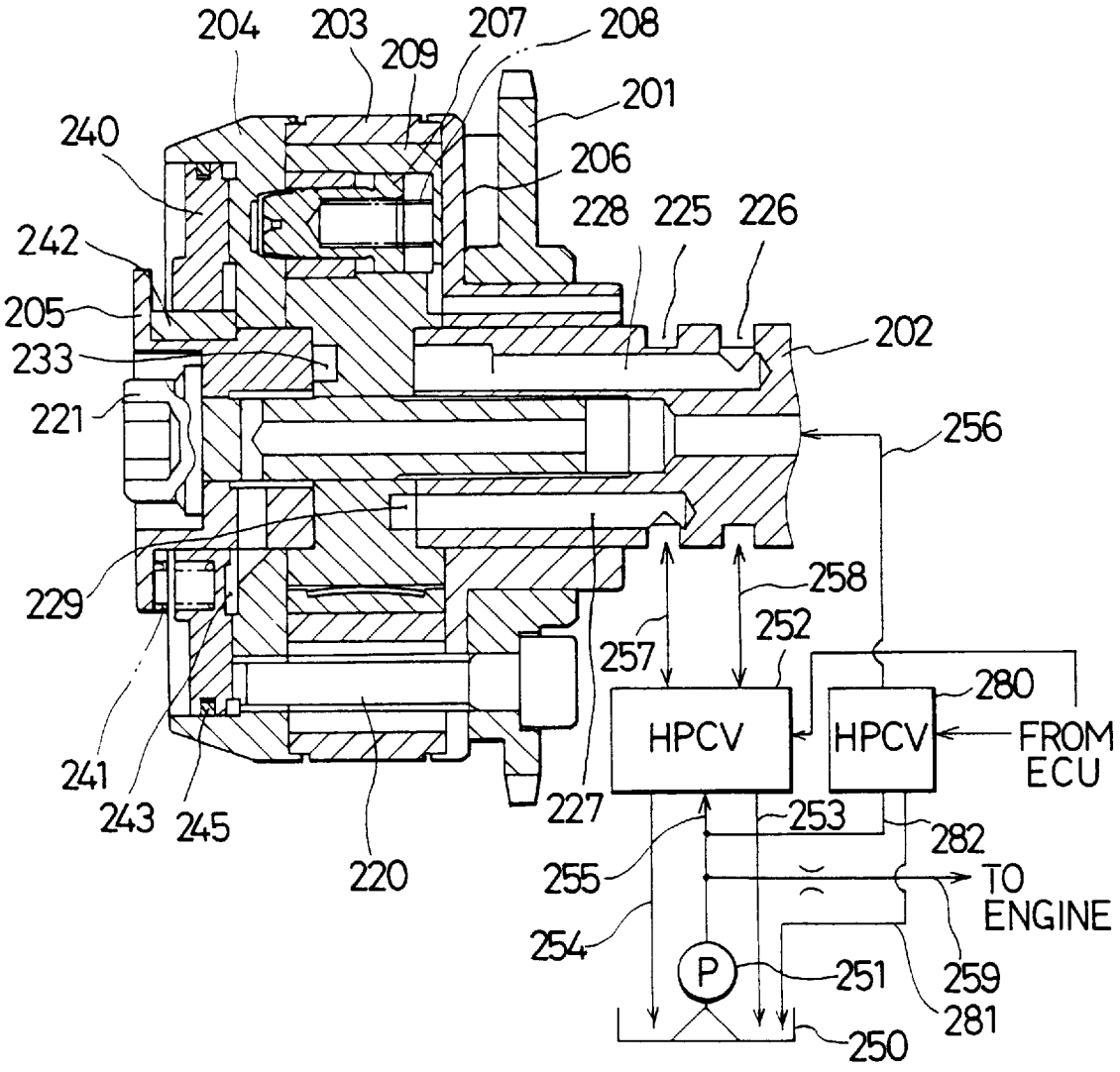
FIG. 22 is a longitudinal sectional view showing a valve timing regulation apparatus according to the fifteenth embodiment.

In FIG. 22 showing the fifteenth embodiment, output fluid pressure of a pump 252 is not directly applied to the release fluid chamber 243 but a fluid control valve 280 is controlled by a command signal from electronic control unit (ECU) according to engine operating conditions to regulate fluid pressure applied to the release fluid chamber 243. Thereby, even in the case where the output fluid pressure of the pump 251 is high during the engine operation, a clutch passage 256 is communicated with a discharge fluid passage 281 to control the fluid control valve 280 so that the pressure of the release fluid chamber 243 lowers whereby the one-way clutch is coupled so that the camshaft 202 can be quickly rotated to the most advance position with respect to the crankshaft. When the fluid pressure of the clutch passage 256 is increased, the fluid control valve 280 is controlled so that the clutch passage 256 is communicated with a supply fluid passage 282 to release the coupling of the one-way clutch.

(Sixteenth Embodiment)

Figure 23:
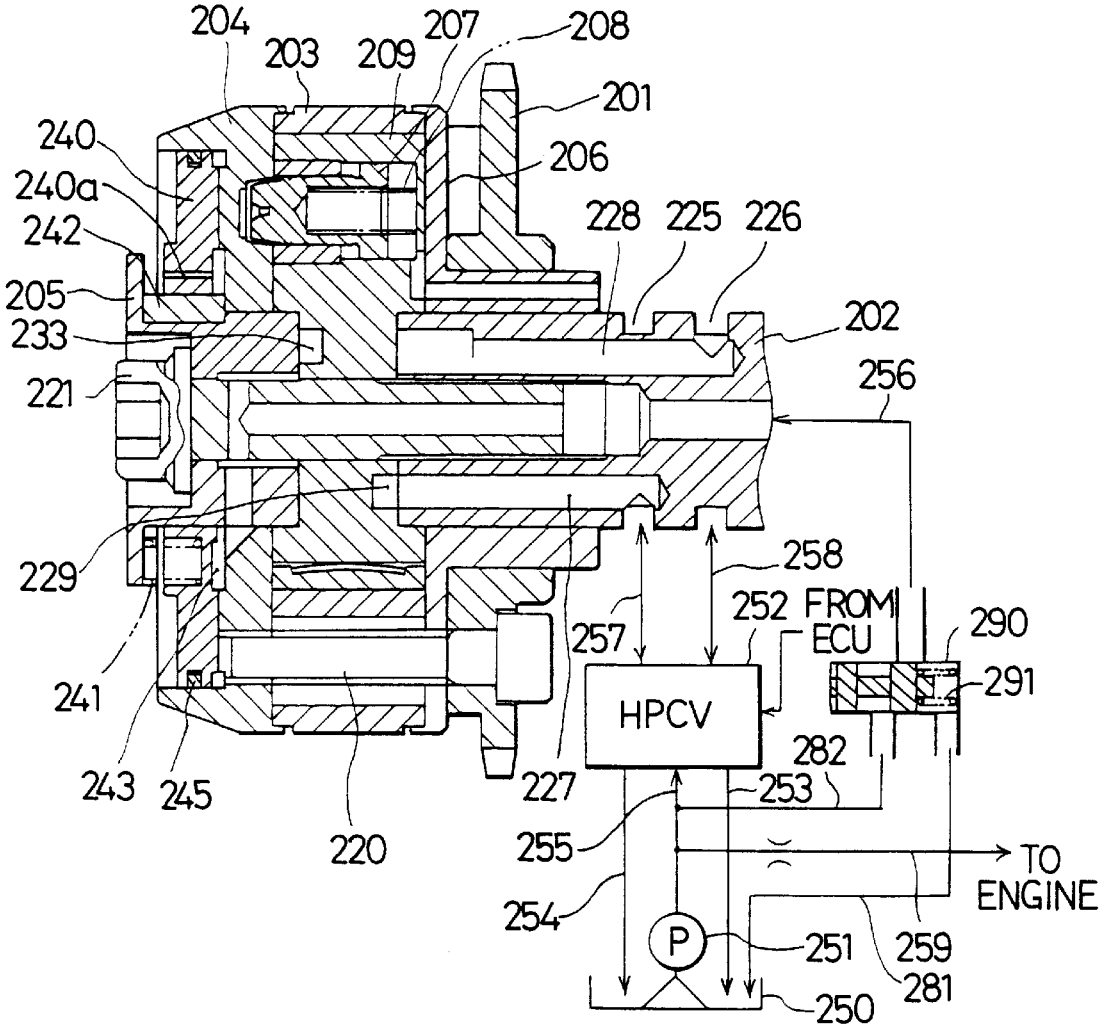
FIG. 23 is a longitudinal sectional view showing a valve timing regulation apparatus according to the sixteenth embodiment.

In FIG. 23 showing the sixteenth embodiment, a fluid control valve 290 is a spool valve in which switching of a passage in communication with the clutch passage 256 is not carried out by the command signal from ECU but carried out mechanically. That is, in the case where the output pressure of the pump 251 is low, the clutch passage 256 is communicated with a discharge fluid passage 281 because the urging force of a spring 291 excels to the force received rightward in FIG. 23 by the fluid control valve 280 from the pump 251. Further, when the output fluid pressure of the pump 151 is high and the force received rightward in FIG. 23 by the fluid control valve 280 from the pump 251 excels to the urging force of the spring 291, the clutch passage 256 is communicated with a supply fluid passage 282.

Further, the clutch piston 240 is provided with a hole 240*a* for quickly removing the residual pressure. Thereby, after the stop of the pump, that is, after the stop of the engine, the pressure of the release fluid chamber 243 immediately lowers.

While in the above eleventh to sixteenth embodiments, when the camshaft is rotated to the most advance position with respect to the crankshaft, the locking mechanism is coupled so that the opening periods of the exhaust valve and the intake valve are not overlapped, it is to be noted that in the range in which the operating condition of the engine can be continued, the opening periods of the exhaust valve and the intake valve may be overlapped, and the coupling position of the locking mechanism may be the retard side rather than the most advance position.

(Seventeenth Embodiment)

Figure 24:
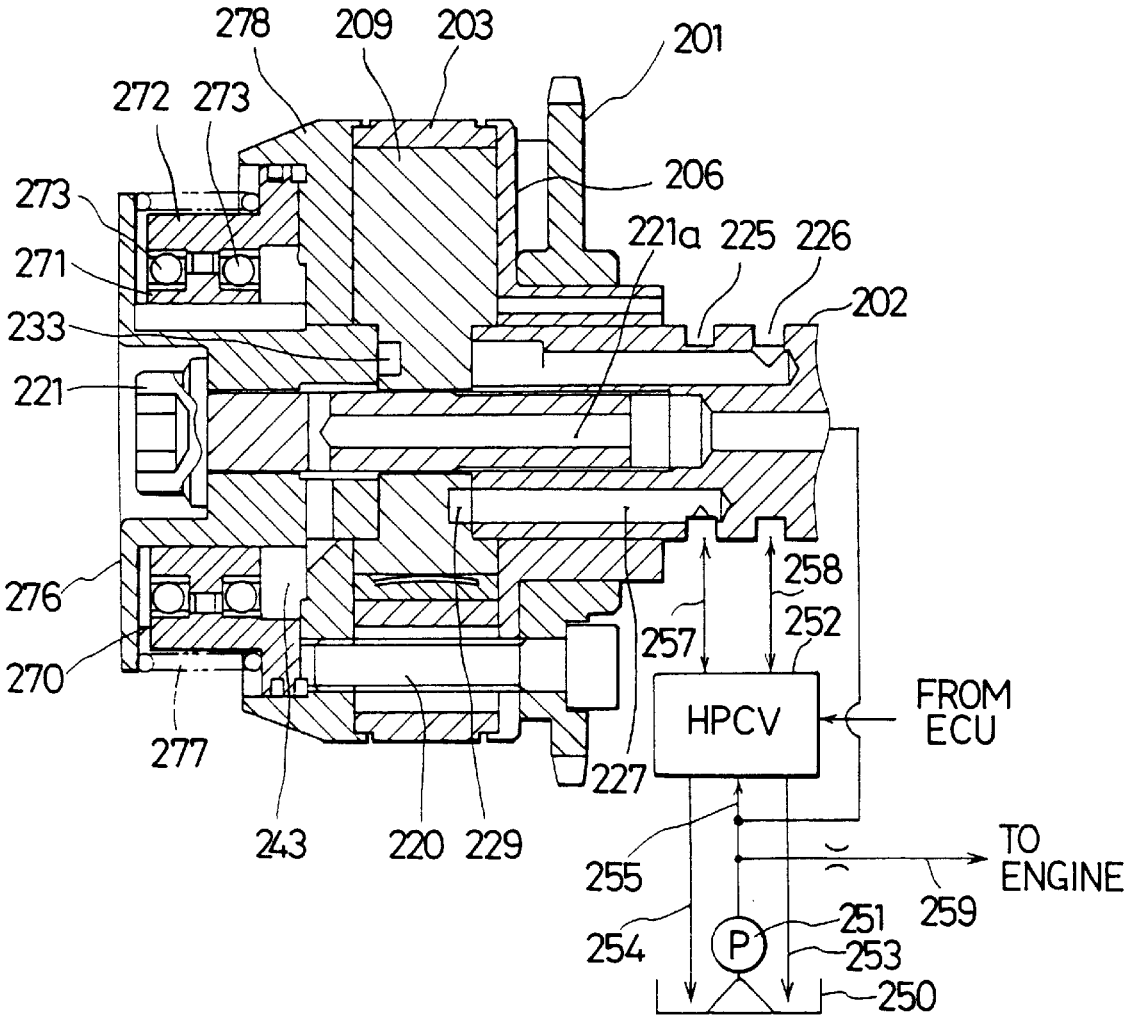
FIG. 24 is a longitudinal sectional view showing a valve timing regulation apparatus according to the seventeenth embodiment.

In FIG. 24 showing the seventeenth embodiment, no locking mechanism for coupling the vane rotor 209 with the front plate 278 is provided.

(1) When the engine stops normally, the camshaft 202 is stopped at the most advance position with respect to the crankshaft, and one-way clutch 270 is coupled. When the engine is started in this state, the camshaft 202 is held at the most advance position even if the locking mechanism is not provided since the one-way clutch remained coupled till the operating fluid is introduced into the release fluid chamber 243. Accordingly, the engine starts normally.

(2) Even in the case where the camshaft 202 cannot be stopped at the most advance angle with respect to the crankshaft, the camshaft 202 is quickly rotated to the most advance position with respect to the crankshaft by the one-way clutch 270. Therefore, the engine starts normally even if the locking mechanism is not provided.

While in the above-described embodiments of the present invention, the vane type configuration has been used as the drive force transmission means, it is to be noted that the drive force can be transmitted by engagement of helical splines.

Further, while in the present embodiment, a description has been made of the locking mechanism for displacing the stopper piston in an axial direction, it is to be noted that a locking mechanism for displacing the stopper piston in a diametrical direction may be used.

Further, while in the present embodiment, a description has been made of the valve timing apparatus for opening and closing the exhaust valve, it is to be noted that the present invention can be applied to the valve timing apparatus for opening and losing the intake valve.

Furthermore, while the chain sprocket has been used as means for transmitting the drive force of the crankshaft, it is to be noted that a timing pulley can be used in place of the chain sprocket.

The present invention having been described above may further be modified in many other ways without departing from the spirit of the invention.

What is claimed is:

1. A valve timing regulation apparatus for an internal combustion engine, said internal combustion engine including a drive shaft, a driven shaft and a valve for intake or exhaust, the apparatus comprising:

a drive force transmission member provided to transmit a drive force of the drive shaft to the driven shaft for opening and closing the valve of the internal combustion engine wherein the drive shall and the driven shaft are relatively rotated by the drive force transmission member to regulate opening and closing timing of the valve;

a drive-side rotor rotatable along with the drive shaft;

a driven-side rotor rotatable along with the driven shaft; and a spring arranged to urge the driven-side rotor in a direction to advance the driven shaft with respect to the drive shaft, wherein a torque on the driven shaft derived by the force of the spring is set to be at least one of; greater than the maximum torque transmitted to the drive shaft from the driven shaft at the time of start of the internal combustion engine and greater than the average torque transmitted to the drive shaft from the driven shaft at the time of start of the internal combustion engine.

2. A valve timing regulation apparatus for an internal combustion engine having a drive shaft, a driven shaft and a valve for intake or exhaust, the apparatus comprising:

a drive force transmission member provided to transmit a drive force of the drive shaft to the driven shaft for opening and closing the valve of the internal combustion engine so that the drive shaft and the driven shaft are relatively rotated by the drive force transmission member to regulate opening and closing timing of the valve;

a drive-side rotor rotatable along with the drive shaft;

a driven-side rotor rotatable along with the driven shaft; and first urging means to urge the driven-side rotor in a direction to advance the driven shaft with respect to the drive shaft, wherein a torque on the driven shaft derived by urging force of the first urging means is set greater than the maximum torque transmitted to the driven shaft from the drive shaft at the time of stat of the internal combustion engine.

3. A valve timing regulation apparatus for an internal combustion engine having a drive shaft, a driven shaft and a valve for intake or exhaust, the apparatus comprising:

a drive force transmission member provided to transmit a drive force of the drive shaft to the driven shaft for opening and closing the valve of the internal combustion engine so that the drive shaft and the driven shaft are relatively rotated by the drive force transmission member to regulate opening and closing timing of the valves;

a drive-side rotor rotatable along with the drive shaft;

a driven-side rotor rotatable along with the driven shaft; and first urging means to urge the driven-side rotor in a direction to advance the driven shaft with respect to the drive shaft, wherein a torque on the driven shaft derived by the urging force of the first urging means is greater than an average torque transmitted to the driven shaft from the drive shaft at the time of start of the internal combustion engine.

4. The valve timing regulation apparatus for an internal combustion engine according to claim 3, further comprising:

a locking mechanism provided to couple the drive-side rotor and the driven-side rotor, the locking mechanism being capable of locking the driven-side rotor at a most advance position at a time of start of the internal combustion engine.

5. The valve timing regulation apparatus for an internal combustion engine according to claim 4, wherein the locking mechanism includes:

a stopper hole formed in one of the drive-side rotor or the driven-side rotor;

a stopper displaceably received in the other of the drive-side rotor or the driven-side rotor, the stopper being fittable in the stopper hole; and second urging means for urging the stopper against a fitting side with the stopper hole.

6. The valve timing regulation apparatus for an internal combustion engine according to claim 5, wherein:

the stopper couples the drive-side rotor with the driven-side rotor by urging force of the second urging means when fluid pressure is not operated, and releases the coupling between the drive-side rotor and the driven-side rotor when fluid pressure in excess of a predetermined pressure is operated.

7. The valve timing regulation apparatus for an internal combustion engine according to claim 3, wherein:

the drive force transmission member includes gears divided into at least two in at least one of an axial direction and a peripheral direction to couple with the drive-side rotor and the driven-side rotor by a helical spline, the gears being urged in the directions opposite to each other.

8. The valve timing regulation apparatus for an internal combustion engine according to claim 2, wherein:

the drive force transmission member includes gears divided into at least two in at least one of an axial direction and a peripheral direction to couple with the drive-side rotor and the driven-side rotor by a helical spline, the gears being urged in the directions opposite to each other.

9. A valve timing regulation apparatus for an internal combustion engine having a drive shaft, a driven shaft and a valve for intake or exhaust, the apparatus comprising:

a drive force transmission member provided to transmit a drive force of the drive shaft to the driven shaft for opening and closing the valve of the internal combustion engine so that the drive shaft and the driven shaft are relatively rotated by the drive force transmission member to regulate opening and closing timing of the valve;

a drive-side rotor rotatable along with the drive shaft;

a driven-side rotor rotatable along with the driven shaft; and first urging means to urge the driven-side rotor in a direction to advance the driven shaft with respect to the drive shaft;

wherein, the drive force transmission member includes gears which are divided into two or more in an axial direction or in a peripheral direction to couple with the drive-side rotor and the driven-side rotor by a helical spline, the gears being urged in the directions opposite to each other, a torque on the driven shaft derived by the urging force of the first urging means is greater than the average torque transmitted to the driven shaft from the drive shaft at the time of start of the internal combustion engine, and the sum of the torque on the driven shaft derived by the urging force of the first urging means and the torque derived by the urging force for urging the gears in the direction in which the driven-shaft advances relative to the drive shaft is greater than the maximum torque transmitted to the driven shaft from the drive shaft at the time of start of the engine.

10. The valve timing regulation apparatus for an internal combustion engine according to claim 9, wherein:

the urging force for urging the gears to move the driven-shaft in the retard direction relative to the drive shaft is smaller than the urging force for urging the gears to move in the driven-shaft in the advance direction relative to the drive shaft.

* * * * *